US007481028B2

(12) United States Patent
Tufts et al.

(10) Patent No.: US 7,481,028 B2
(45) Date of Patent: Jan. 27, 2009

(54) MULLING AND SEALING SYSTEM FOR COMPOUND FENESTRATION UNITS

(75) Inventors: Thomas Tufts, Woodbury, MN (US); Craig M. Johnson, St. Paul, MN (US); Corey M. Bishman, Woodbury, MN (US); Robert J. Geisen, Stillwater, MN (US)

(73) Assignee: Anderson Corporation, Bayport, MN (US)

( * ) Notice: Subject to any disclaimer, the term of this patent is extended or adjusted under 35 U.S.C. 154(b) by 249 days.

(21) Appl. No.: 11/488,479

(22) Filed: Jul. 17, 2006

(65) Prior Publication Data

US 2008/0010919 A1 Jan. 17, 2008

(51) Int. Cl.
*E06B 3/00* (2006.01)
*E06B 7/00* (2006.01)
*E06B 3/964* (2006.01)

(52) U.S. Cl. ..... 52/214; 52/204.58; 52/204.599; 52/204.62; 52/204.5; 52/208

(58) Field of Classification Search ..... 52/204.58, 52/204.599, 204.62, 208, 214, 235, 656.5, 52/717.03, 730.3, 393–395, 396.05; 14/73.1; 404/47, 56, 65–68
See application file for complete search history.

(56) References Cited

U.S. PATENT DOCUMENTS 3,923,411 A * 12/1975 Berghman ..... 404/64
3,967,911 A * 7/1976 Miers ..... 404/48
4,328,644 A 5/1982 Scott et al.
4,691,489 A * 9/1987 Shea, Jr. ..... 52/235
4,809,463 A * 3/1989 Schroder et al. ..... 49/377
4,810,321 A 3/1989 Wank et al.
4,924,647 A 5/1990 Drucker
5,076,034 A 12/1991 Bandy
5,435,106 A 7/1995 Garries et al.
5,540,019 A 7/1996 Beske et al.
6,138,419 A 10/2000 Sekiguchi et al.
6,360,498 B1 3/2002 Westphal
6,500,558 B2 12/2002 Yamaguchi
6,523,311 B2 2/2003 Edger
6,662,512 B2 12/2003 Westphal
6,811,893 B2 11/2004 Wakayama et al.

FOREIGN PATENT DOCUMENTS

JP 10-037325 A2 2/1998

* cited by examiner

*Primary Examiner*—Richard E Chilcot, Jr.
*Assistant Examiner*—Branon C Painter
(74) *Attorney, Agent, or Firm*—Womble Carlyle Sandridge & Rice

(57) ABSTRACT

A system is provided for coupling individual fenestration units together and sealing the gaps between them so as to form a sealed compound fenestration unit. The individual fenestration units include mating channels and tabs, or other connectors, that are attached to outside frame surfaces of the individual fenestration units. When the connectors are coupled together, they attach the frames of the individual fenestration units securely together in such a way that gaps are formed between the units along their joined frame surfaces. The gaps are sealed by resilient sealing strips that are configured to be inserted into the gaps, and that are formed with seals that bear against the walls of the gaps to form impervious moisture seals.

8 Claims, 37 Drawing Sheets

MULLING AND SEALING SYSTEM FOR COMPOUND FENESTRATION UNITS

TECHNICAL FIELD

This invention relates generally to fenestration and more particularly to compound windows and doors formed from two or more individual window or door units joined together or mulled to create a larger multi-unit fenestration assembly.

BACKGROUND

Compound fenestration units, commonly referred to as mulled fenestration units, are formed by joining two or more individual window or door units, which will hereinafter be referred to as component units, so as to form a combination of windows, or windows and doors, that can be handled and installed as a single unit, and which give the appearance of being a single unit. A simple system for joining the component units involves the placing of spacer boards between the units to be joined and installing screws or other fasteners through the frames of the component units, into the spacer boards, to join the units. Other systems for joining the units involve the use of interlocking brackets or other like devices that can be separately installed on the facing surfaces of the frames to be joined and then coupled together to form the compound unit.

An important aspect of compound fenestration units is that a great variety of different compound fenestration units can be formed from a relatively limited set of component units. Assembly of component window or door units into compound fenestration units involves not only mechanical coupling of the component window units, but also sealing of the joints between the component units against rain, wind, and other intrusions. Additionally, it is preferred that any sealing system accommodate a variety of gap arrangements and provide a suitable appearance to the compound unit. Silicone RTV, for example, can provide effective sealing for virtually any gap arrangement, either by itself or in combination with weather stripping or other covering or trim pieces, but the appearance of the sealed unit may be less than desirable, and may not provide the desired appearance of a single integrated unit. Additionally, the skill and equipment needed for the proper application of silicone or other like sealants may not always be readily available in all manufacturing settings. More visually pleasing sealing methods, such as preformed gaskets or trim materials can suffer, on the other hand, from a lack of adaptability to different combinations of component window units. There thus is a continuing need for a method and apparatus for joining together individual window units or door units to form multi-unit fenestration assemblies that addresses the problems and shortcomings of the prior art. It is to the provision of such that the present invention is primarily directed.

SUMMARY OF THE INVENTION

A system for creating compound fenestration units having sealed interfaces between the component units is disclosed. Briefly described, the system includes coupling structures for quickly and conveniently connecting component units to form robust compound units, as well as a sealing system for sealing the interfaces between the component units.

The coupling structures provide coupling members that are attached to component units and then coupled to one another by interlocking channels and tabs. In one embodiment, the coupling members extend along the edge of the component units to be joined, and may extend beyond the edges, from one component unit to another, so as to reinforce the compound unit. In another embodiment, the coupling members are relatively discrete components, several of which are attached at various points along the edges of the various component units. The coupling structures also control the spacings between the component units so as to cooperate with a system of sealing components provided for sealing the gaps between the component units.

The sealing system is of a dual seal type, with exterior, or shielding seals, and interior, or pressure seals, wherein the interseal cavities between the shielding seals and the pressure seals are provided with drain passages to convey water to a harmless location, such as the exterior of the structure in which the unit is installed. The seals are supported by a low shrink, dimensionally stable material, such as aluminum, so as to form a lineal sealing stock that is compressible in a transverse direction to allow insertion into gaps between component units, yet sufficiently rigid to urge the seals into sealing contact with the surfaces against which they are to seal. As used herein, the term lineal will refer to an elongated structure having a constant cross section over its length. Examples of lineals include stock materials of indefinite length, and components of a specific length that may, in addition, have specific end configurations to enable them to fit with other surfaces. The system of the present invention includes lineal sealing stock material for vertical gaps between component units and lineal sealing stock having an additional drip edge for sealing horizontal gaps between component units. The system further comprises end sealing components that cooperate with the pressure seals as well as with the shielding seals to provide pressure sealing where needed and ventilation and drainage where needed. The invention will be better appreciated upon review of the detailed description set forth below in conjunction with the accompanying drawing figures, which are briefly described as follows.

DETAILED DESCRIPTION OF THE PREFERRED EMBODIMENTS

Figure 1:
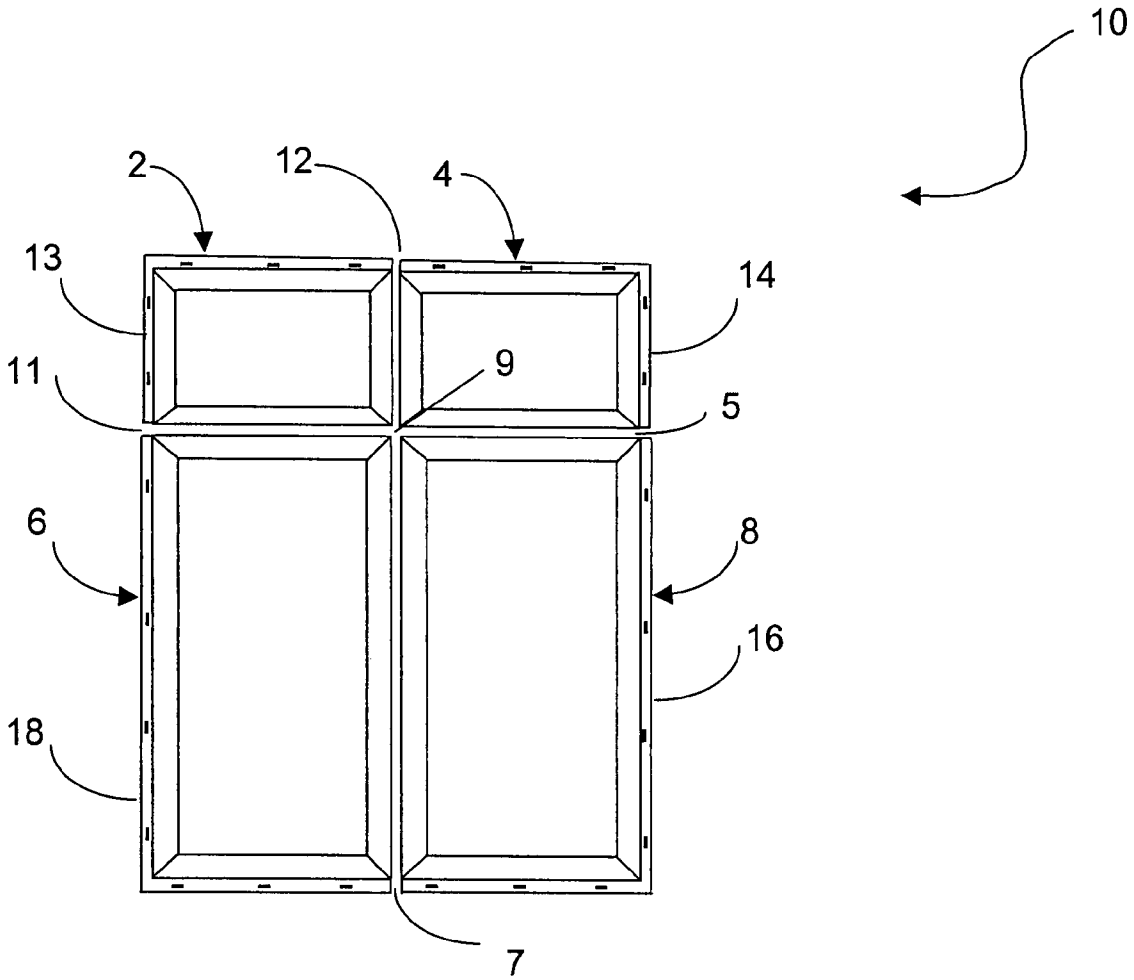
FIG. 1 is an elevation view of a compound fenestration unit.

FIG. 1 portrays a compound fenestration unit 10 made up of component units 2, 4, 6, and 8, joined at their edges in a way that provides a single integrated unit. As used herein, the edge of a fenestration unit will refer to the surfaces that face one another when component units are joined into compound units. The plane of a fenestration unit will refer to the plane of the pane or other glazing unit. The interfaces between the units include horizontal gap 5 and vertical gap 7, which cross at gap junction 9, wherein each of gaps 5 and 7 have a predetermined width. Each component unit is provided with nailing flanges such as 13, 14, 16, and 18. Nailing flanges on the component units may be integral with each component unit, so as to completely surround the unit, in which case the portions of the nailing flanges on mating sides of the units to be joined are removed prior to assembly of the compound unit, leaving the peripheral portions of the nailing flanges for the compound unit. Alternatively, nailing flanges may be provided as separate parts, in which case they may be cut to length from stock material and installed on the outer periphery of the compound unit after assembly of the unit.

Figure 2:
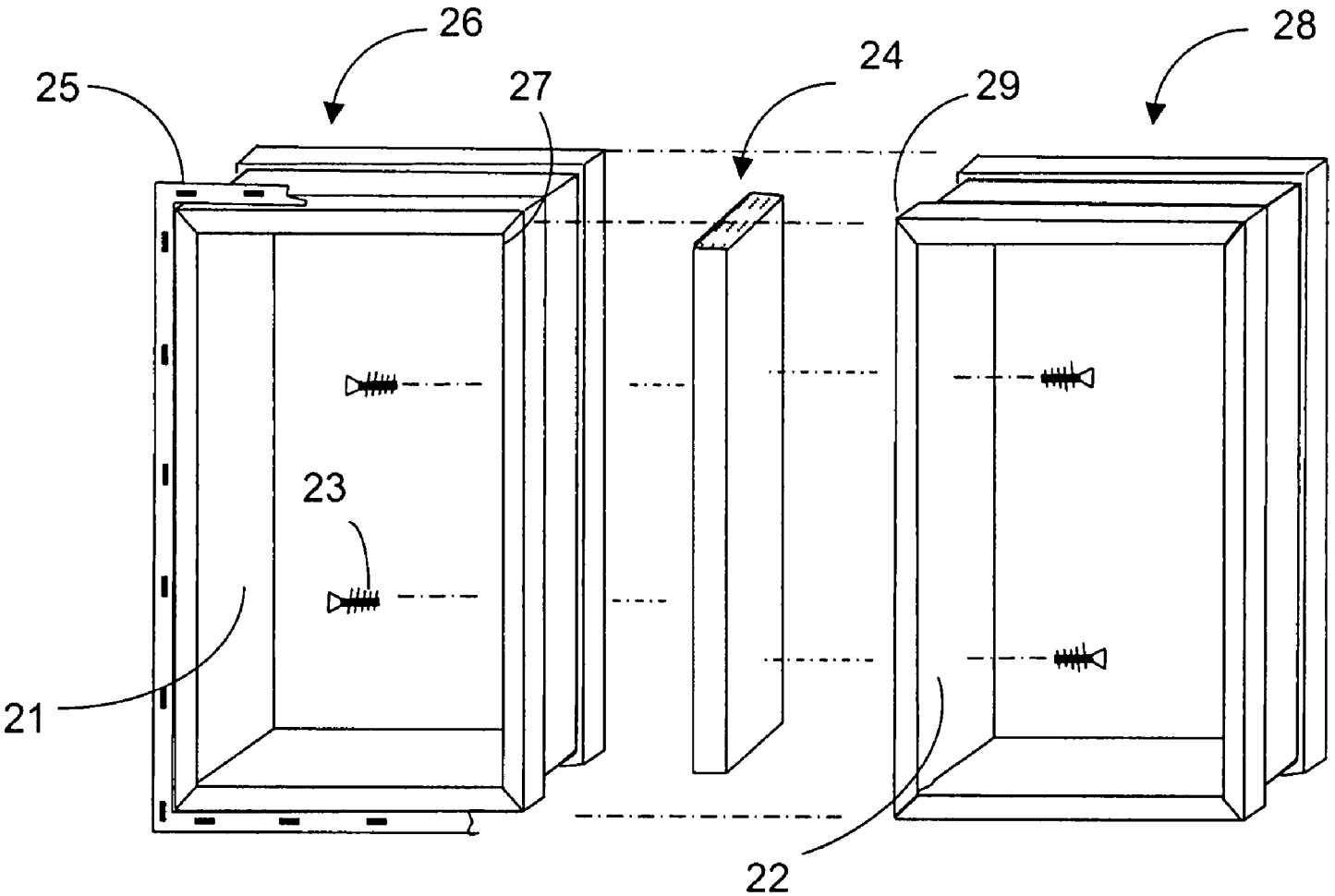
FIG. 2 is an embodiment of a system for joining component units to form a compound fenestration unit.
Figure 3:
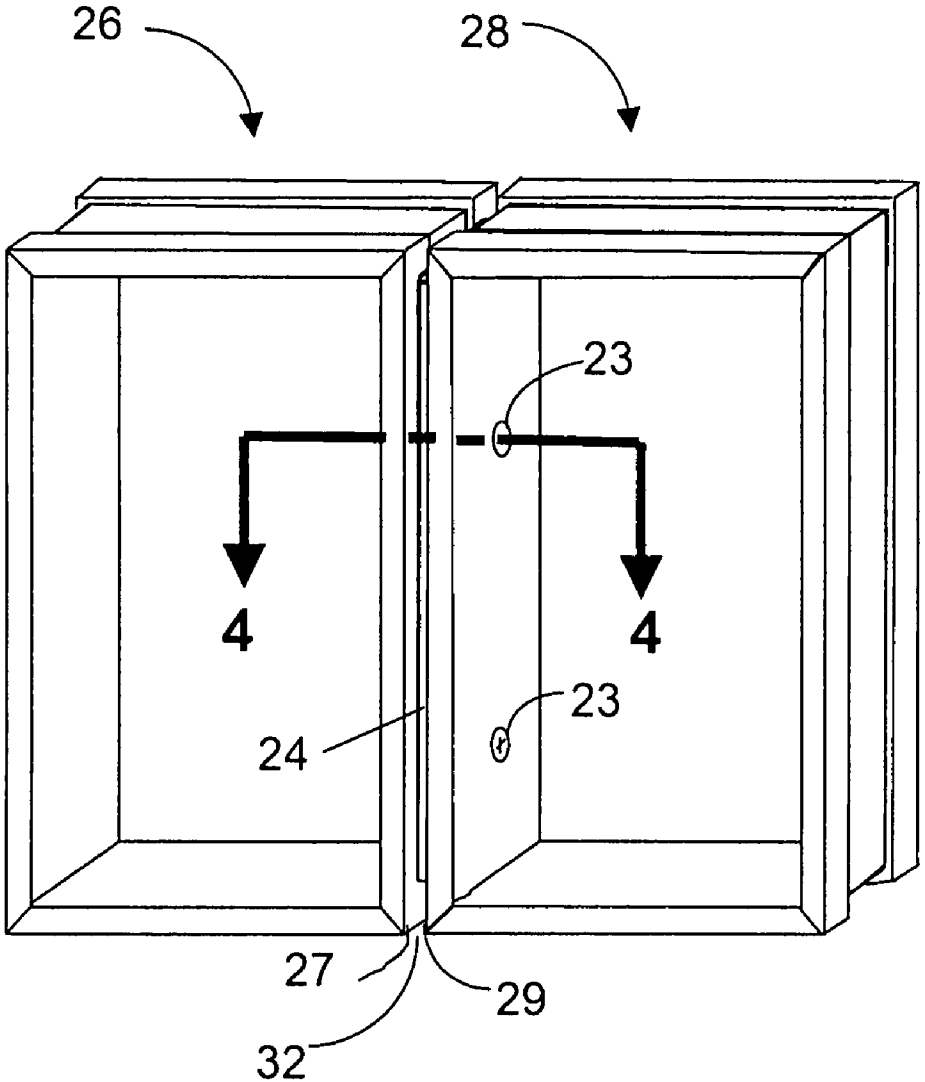
FIG. 3 is a compound fenestration unit joined in the manner portrayed in FIG. 2.
Figure 4:
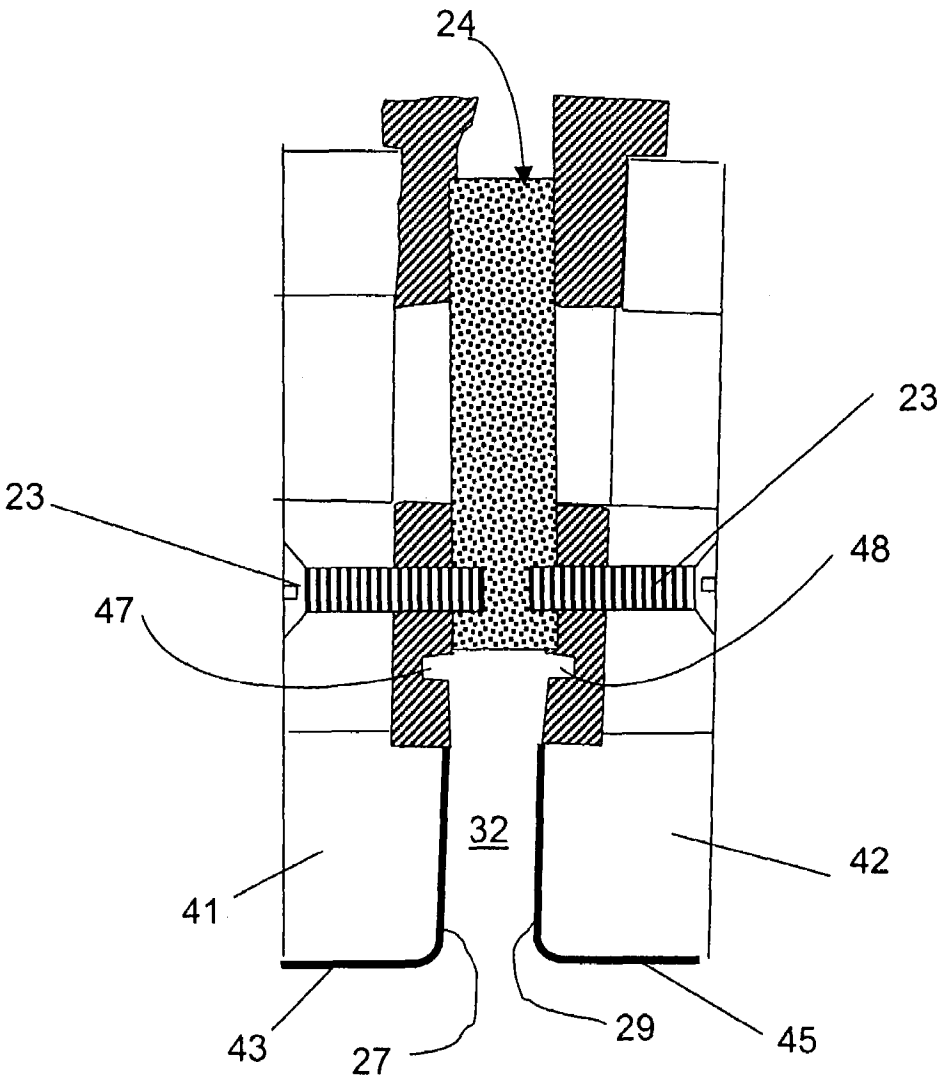
FIG. 4 is a cross sectional view of the joint connecting the component units portrayed in FIGS. 1-3.

Joining of the component units can be accomplished in a variety of ways. In the example shown in FIG. 2, sashes, jamb liners, and other window component unit parts have been removed, to allow access to frames 26 and 28, so that they can be attached to spacer board 24 by screws 23. As shown in FIG. 3, the thickness of board 24 determines the spacing between the units, in particular the spacing between sealing faces 27 and 29, so as to define gap 32. Referring to FIG. 4, sealing faces 27 and 29 are typically formed by exterior trim cladding layers 43 and 45, which can be made from, for example, polymeric materials such as PVC, or from aluminum.

The steps of removing sashes and other parts from component window units prior to assembly into compound units, and then later replacing them, can be inconvenient and time-consuming. This step can be eliminated by the use of coupling systems that comprise a first coupling member that attaches, by external attachment means, to a first component unit, and a second coupling member that attaches, by external attachment means, to a second component unit, without the need to remove internal parts of the component units. The first and second coupling members are then interengaged with one another, thereby coupling the two component units together. The interengagement can utilize, for example, channels and tabs, wherein the tabs of one coupling member are received by the channels of the other coupling member and are locked in place by a clamping or wedging means. More particularly, a first coupling member may comprise a channel opening in a direction perpendicular to the plane of the unit, toward, for example, the exterior side of the unit, and the second coupling member may comprise a tab located in such a way as to be received by the channel in the first coupling member. It is useful for the coupling structures carrying the channels and tabs to be continuous lineal members that extend the full length of the mull. In some cases, this will mean that the coupling members will extend beyond a first unit to a second unit, in which case the coupling member will act as a reinforcement for the overall stiffness of the compound unit. The connection between the two coupling members can be made more rigid by adding an additional channel and tab coupling combination in a location at a suitable distance from the first channel and tab combination. The channel and tab couplings can be locked in place by addition of a wedging device to urge the tab against one wall of the channel. In one embodiment, a wedging screw has been found to be a useful device for locking the coupling members to one another. The wedging screw can be inserted through a hole in the bottom of the channel, parallel to the tab, to wedge itself between the tab and the wall of the channel so as to urge the tab against the wall. The screw can be a thread forming screw to enable it to secure itself in place by partially threading the channel wall or the side of the tab, or both. An embodiment of tab and channel couplings is shown in FIG. 5.

Figure 5:
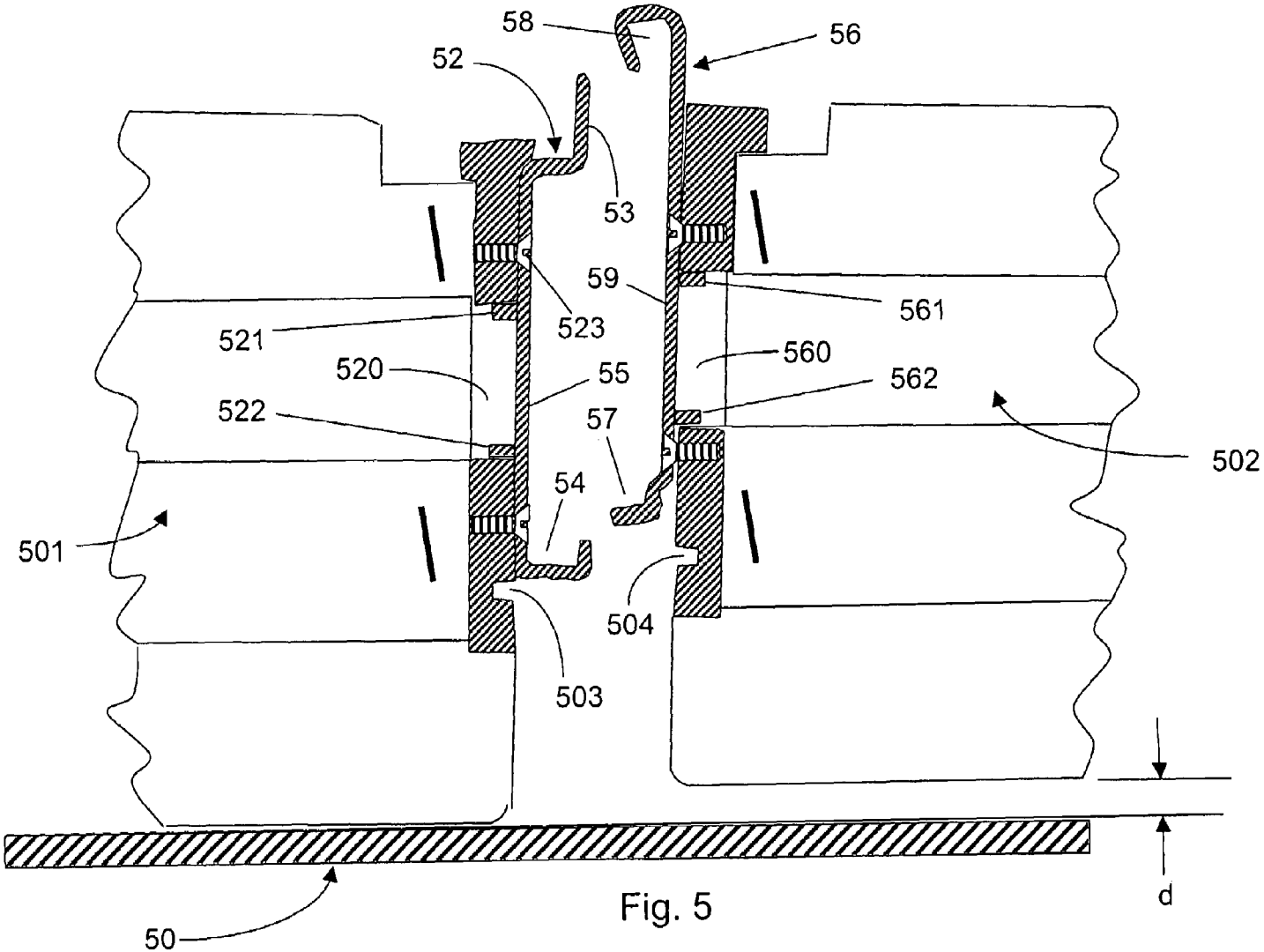
FIG. 5 is a cross sectional view of an embodiment of a channel and tab joining structure, prior to joining.

Referring to FIG. 5, an embodiment of a channel and tab joining structure with a wedging screw is portrayed. The joining structure is made up of first mull coupling member 52, attached to first component unit 501, and second, cooperating, mull coupling member 56, attached to a second component unit 502. First coupling member 52 comprises tab 53 and channel 54, joined by base plate 55. Second mull coupling member 56 comprises channel 58 and tab 57, joined by base plate 59. Positioning of coupling member 52 relative to component unit 501 is determined by alignment channel 520 in unit 501, which receives alignment and load transfer tabs 521 and 522 of first mull coupling 52. In like manner, alignment channel 560 of unit 502 receives alignment and load transfer tabs 561 and 562 of second mull coupling member 56. Tabs 521, 522, 561, and 562 serve not only as locators, but also serve to transfer mechanical loading from coupling members 52 and 56 to component units 501 and 502, respectively, thereby reducing the dependence on screws 523 for coupling of the component units. It will be appreciated that although alignment channels 520 and 560 provide the tab receiving features for the present embodiment, other tab receiving features, such as narrow kerfs, could also be used. Coupling members 52 and 56 can be produced by stamping and bending or roll forming of sheet metal stock, as would be apparent to one skilled in the art. Coupling members 52 and 56 are attached to component units 501 and 502 respectively by screws 523, or by other suitable fasteners, as would be apparent to one skilled in the art.

Figure 6:
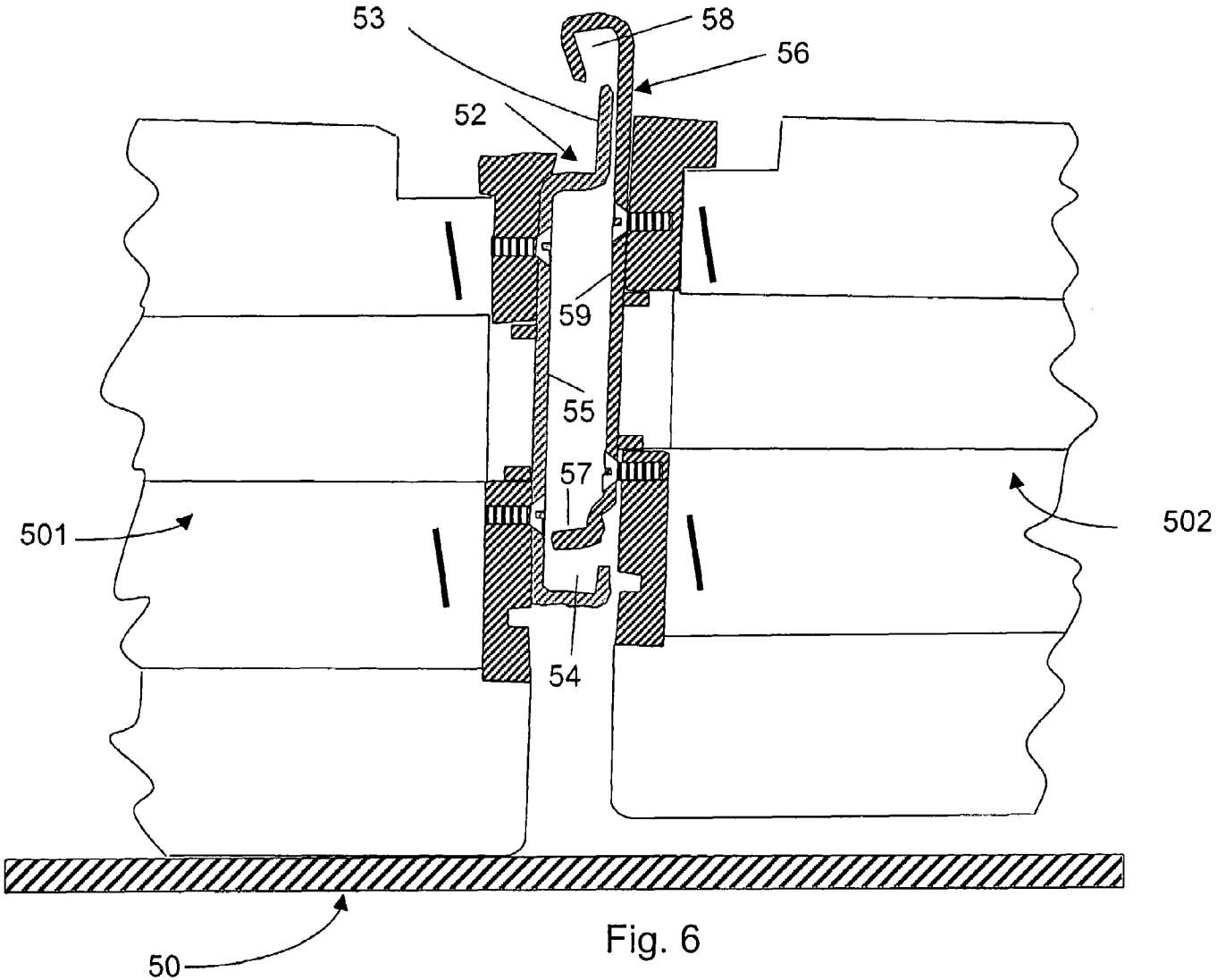
FIG. 6 is the channel and tab joining structure portrayed in FIG. 5 in an intermediate position in preparation for joining.
Figure 7:
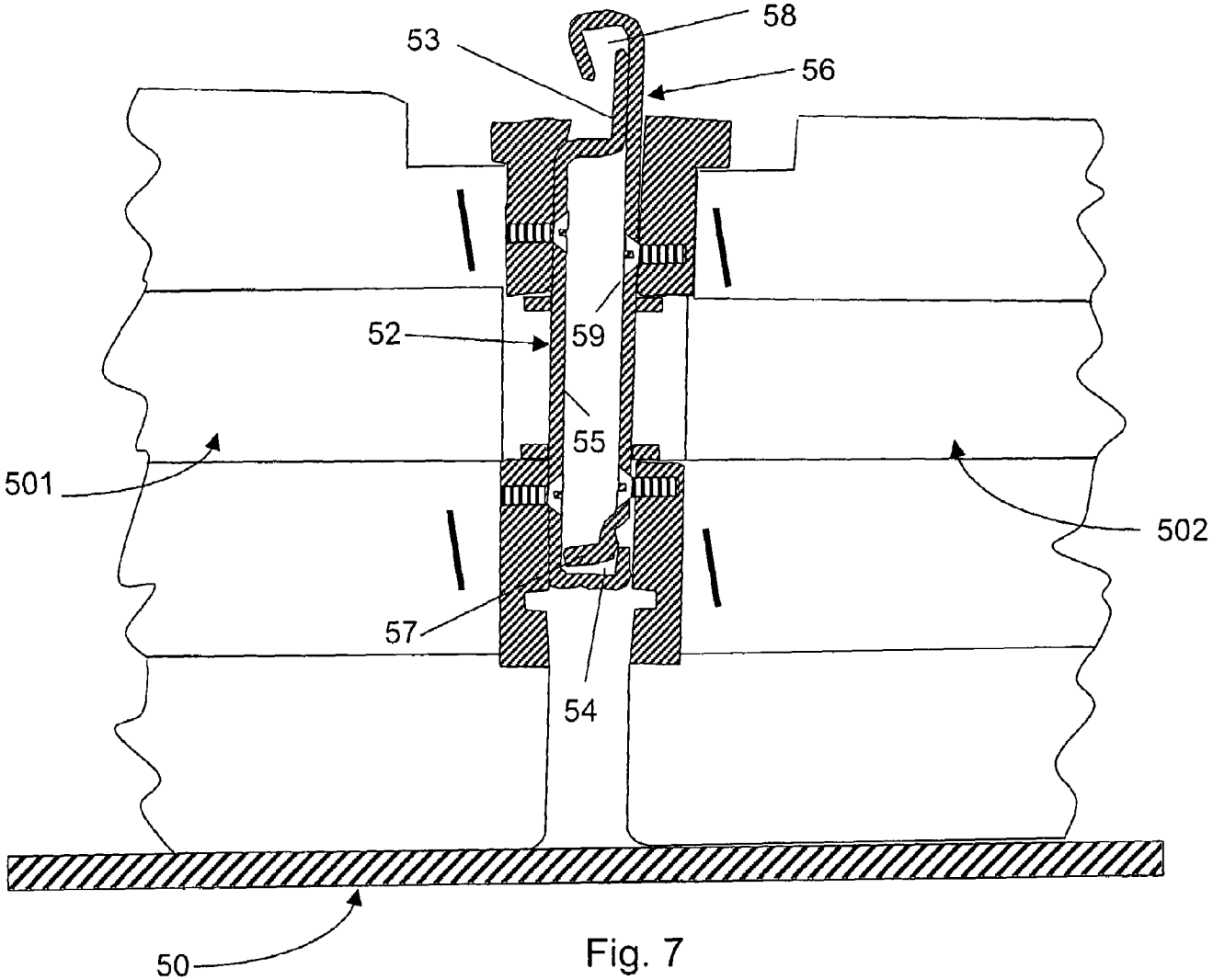
FIG. 7 is the channel and tab joining structure portrayed in FIGS. 5-6 after joining but prior to installation of wedging screws.
Figure 8:
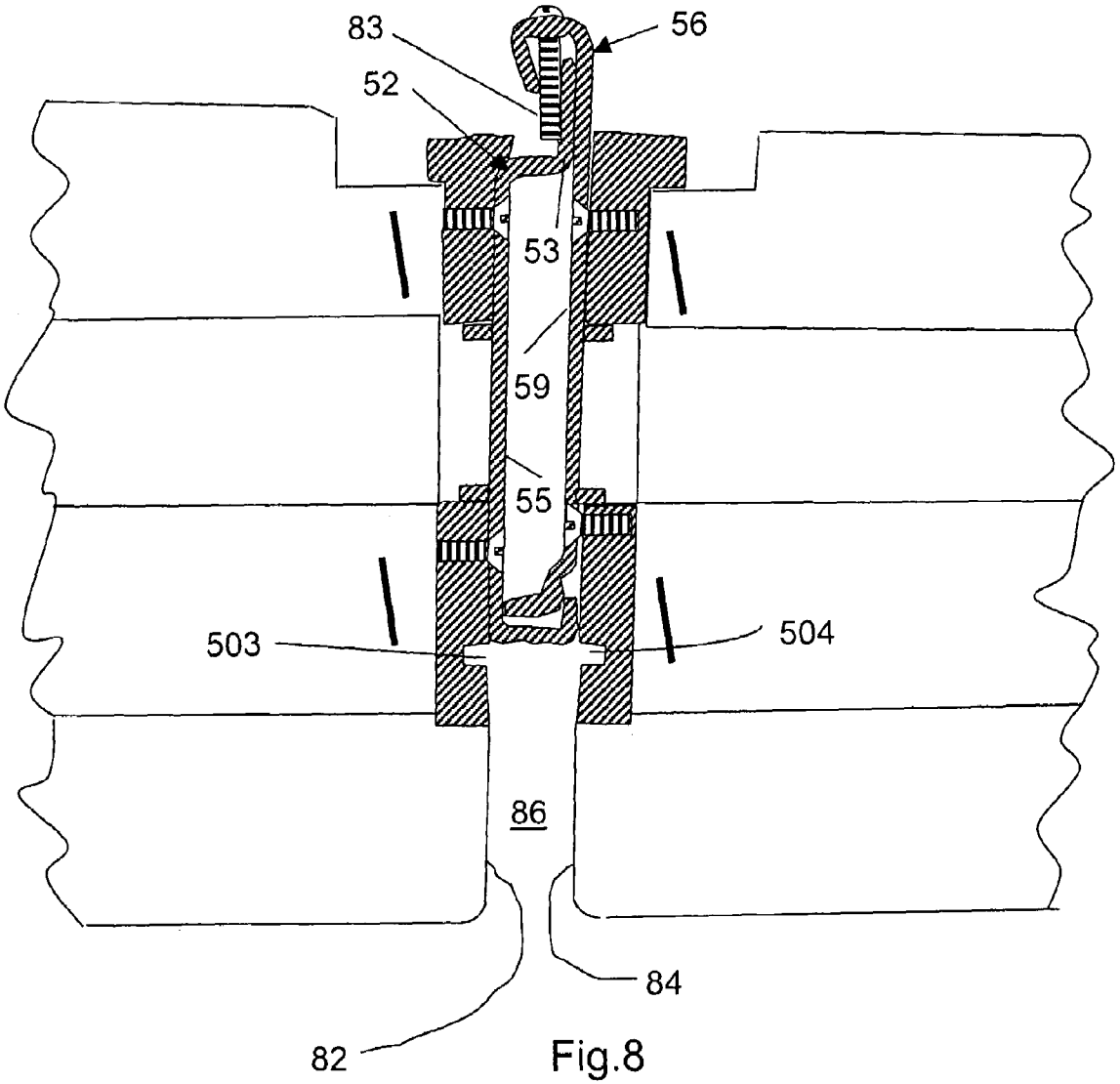
FIG. 8 is the channel and tab joining structure portrayed in FIGS. 5-7 after installation of wedging screws.
Figure 9:
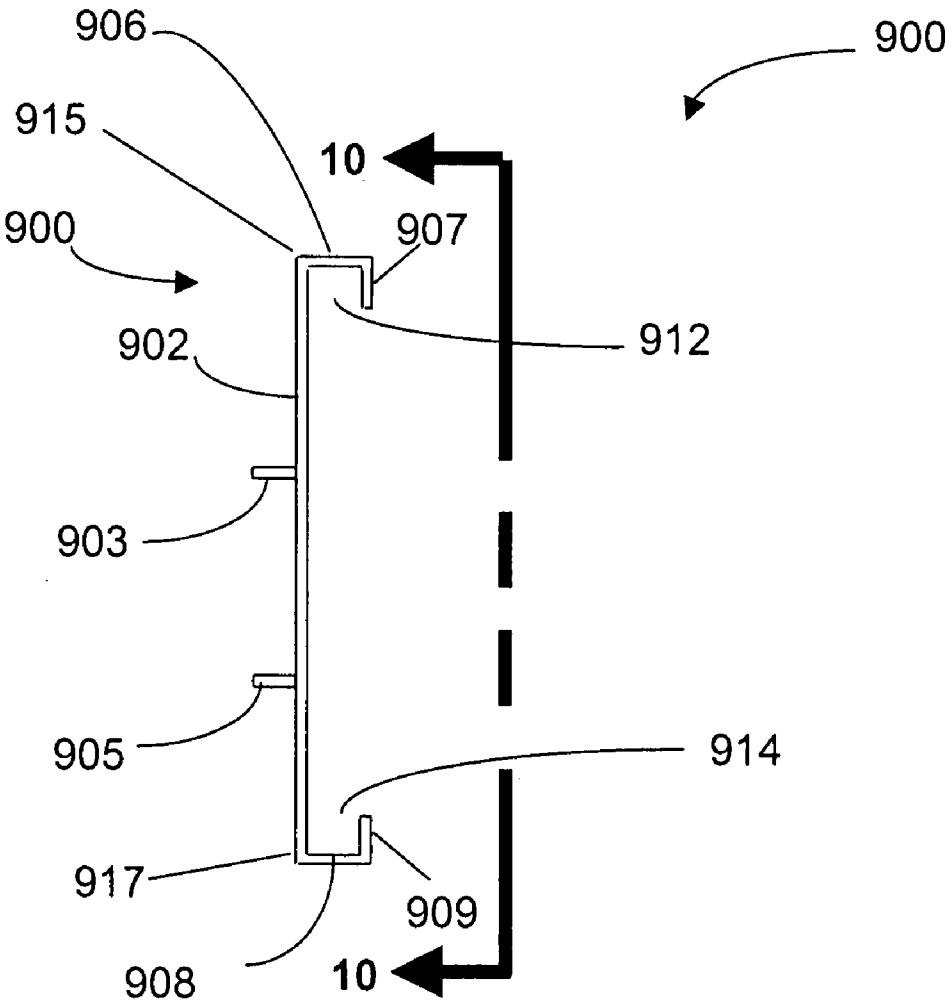
FIG. 9 is a cross sectional view of a first coupling member for an alternative embodiment of a coupling system for connecting component units.
Figure 10:
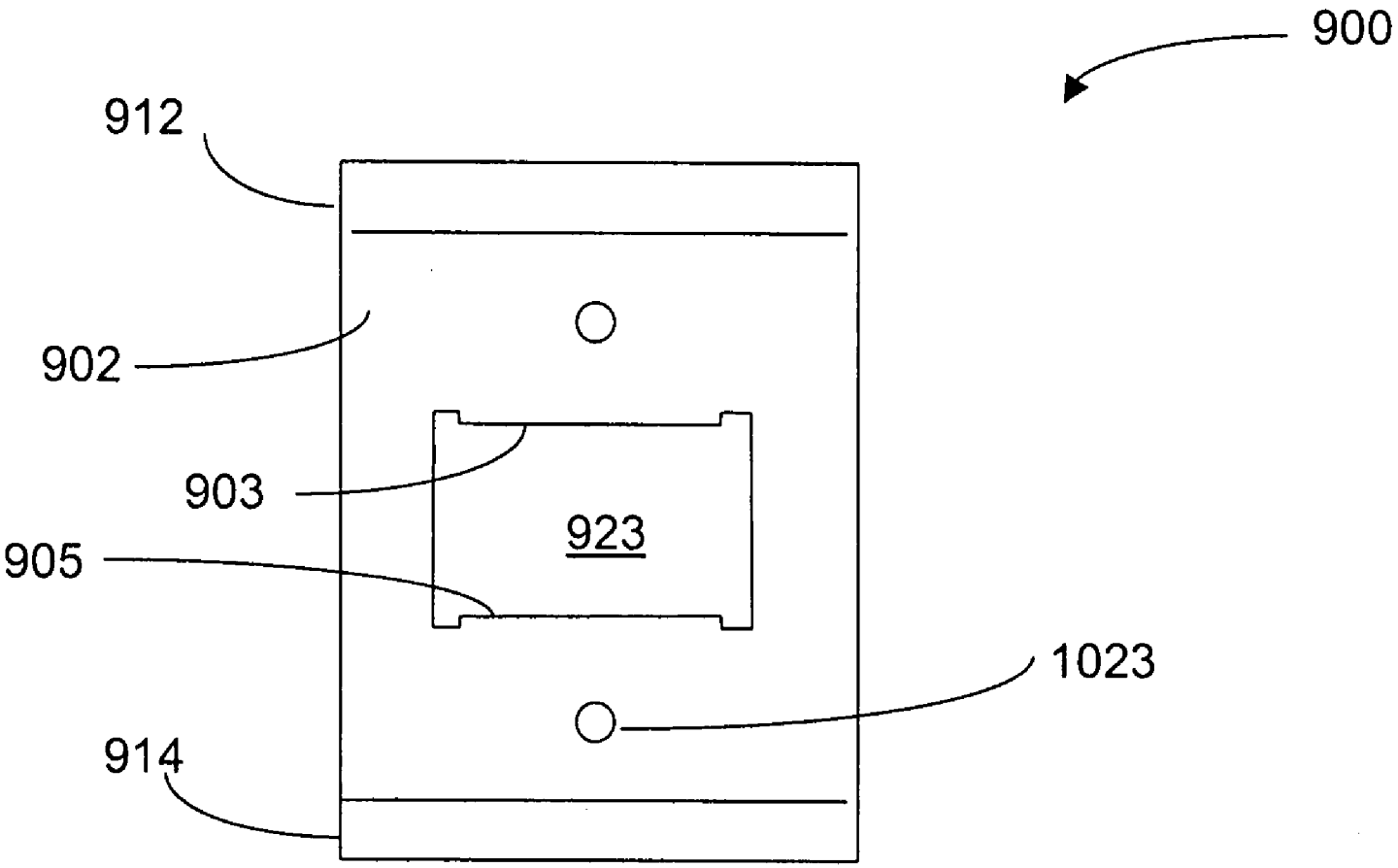
FIG. 10 is an elevation view of the first coupling member portrayed in FIG. 9.

Referring again to FIG. 5, the component units can be conveniently joined by first placing them on flat surface 50 and lifting unit 502 a distance d. The units are then brought together so that tab 53 of first mull coupling member 52 approaches base plate 59 of second mull coupling member 56 and tab 57 of second mull coupling member 56 approaches base plate 55 of first mull coupling member 52, as shown in FIG. 6. Referring to FIG. 7, component unit 502 is then lowered, engaging tab 53 with channel 58 and simultaneously engaging tab 57 with channel 54. The coupling formed by the combination of coupling members 52 and 56 is then locked by a series of wedging screws 83, shown in FIG. 8. Holes for receiving screws 83 can be predrilled or prepunched prior to assembly. Fixturing may be useful during the installation of screws 83 to prevent movement of coupling member 56 relative to coupling 52 during installation of screws 83. It may also be useful to attach gusset plates or other reinforcing members to hold the components in more firmly fixed positions relative to one another both during and after assembly. After the component units have been joined, a gap 86 is defined by first sealing face 82 and second sealing face 84. Additionally, gap 86 may contain first anchoring kerf 503 and second anchoring kerf 504 for receiving anchoring portions of a mull sealing member.

Mull coupling members 52 and 56 may be provided as lineal members that extend along the full edges of the component units, and may also extend beyond a single component unit to adjacent component units. They may extend the full height or width of the compound unit, so as to act as a reinforcing structure for the compound unit. More particularly, in the compound unit portrayed in FIG. 1, coupling members can extend from the bottom of bottom units 6 and 8 to the top of top units 2 and 4, thereby providing additional reinforcement to the compound unit. Alternatively, a horizontal coupling member could extend the full length of horizontal gap 5, from the left sides of units 2 and 6 to the right sides of units 4 and 8, so as to bridge the component units in the horizontal direction.

Referring to FIGS. 9-15, an alternative embodiment of a coupling system for connecting component units is portrayed. In this embodiment, the coupling members are relatively short discrete components placed at suitable intervals along the edges of component window units to be joined, rather than being continuous coupling members, as disclosed in the previous embodiment. In this embodiment, first coupling member 900 comprises a base plate 902, as portrayed in FIG. 9, from which protrude alignment and load transfer tabs 903 and 905 in a first direction, and from which further protrude channel base portions 906 and 908, at edges 915 and 917, respectively, in a second direction. Lip portions 907 and 909 are attached to channel base portions 906 and 908 to form first channel 912 and second channel 914 respectively. While the various parts of side mull coupling member 900 are described as separate entities, it will be apparent to one skilled in the art that coupling member 900 can be produced as a single part, by, for example, stamping and bending of sheet metal. The formation of alignment and load transfer tabs 903 and 905 can be aided by first forming aperture 923, shown in FIG. 10, and then bending suitably punched tabs to form alignment and load transfer tabs 903 and 905. Referring again to FIG. 10, a side elevational view of first mull coupling member 900 shows a typical length to height aspect ratio of first mull coupling member 900, as well as screw holes 1023 for attachment to component unit frames.

Figure 11:
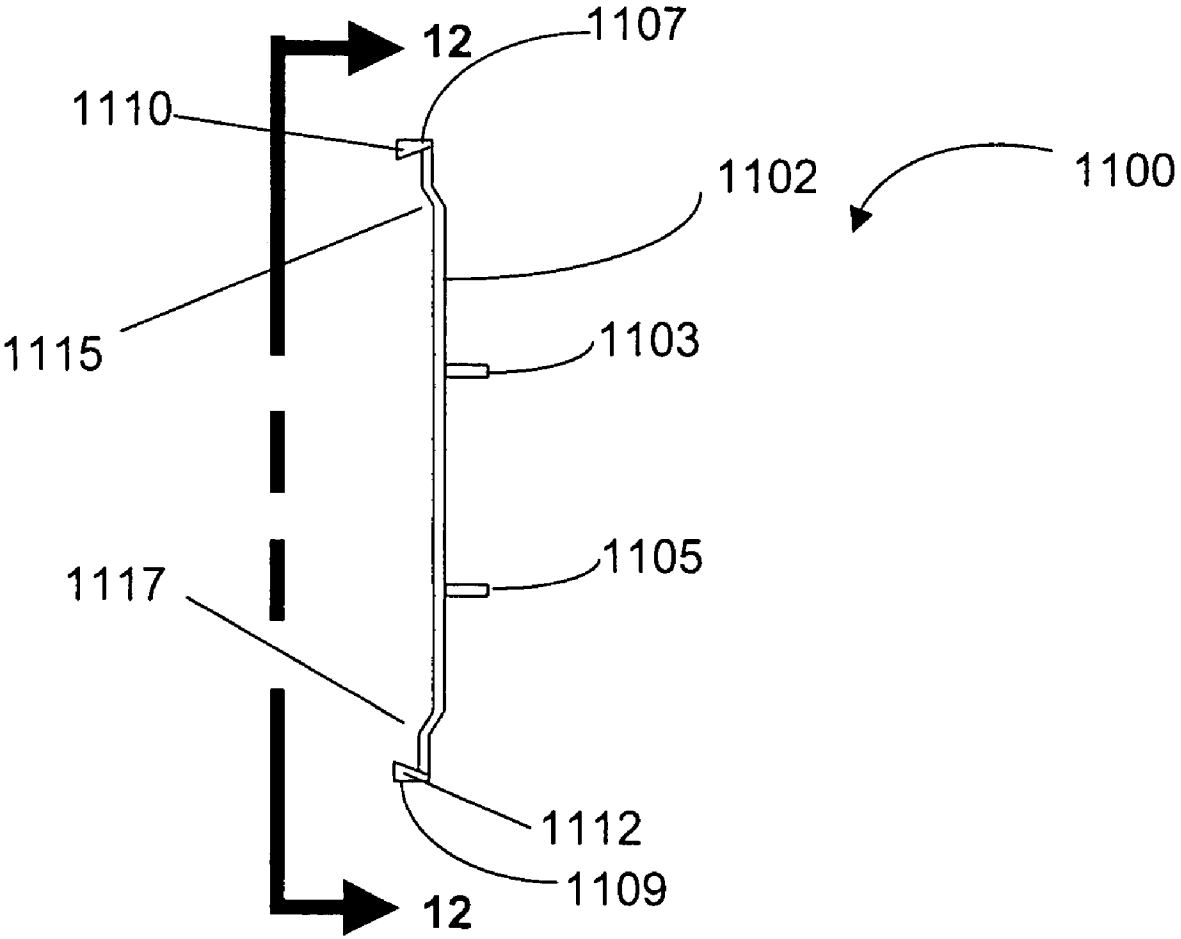
FIG. 11 is a cross sectional view of a second coupling member for an alternative embodiment of a coupling system for connecting component units.
Figure 12:
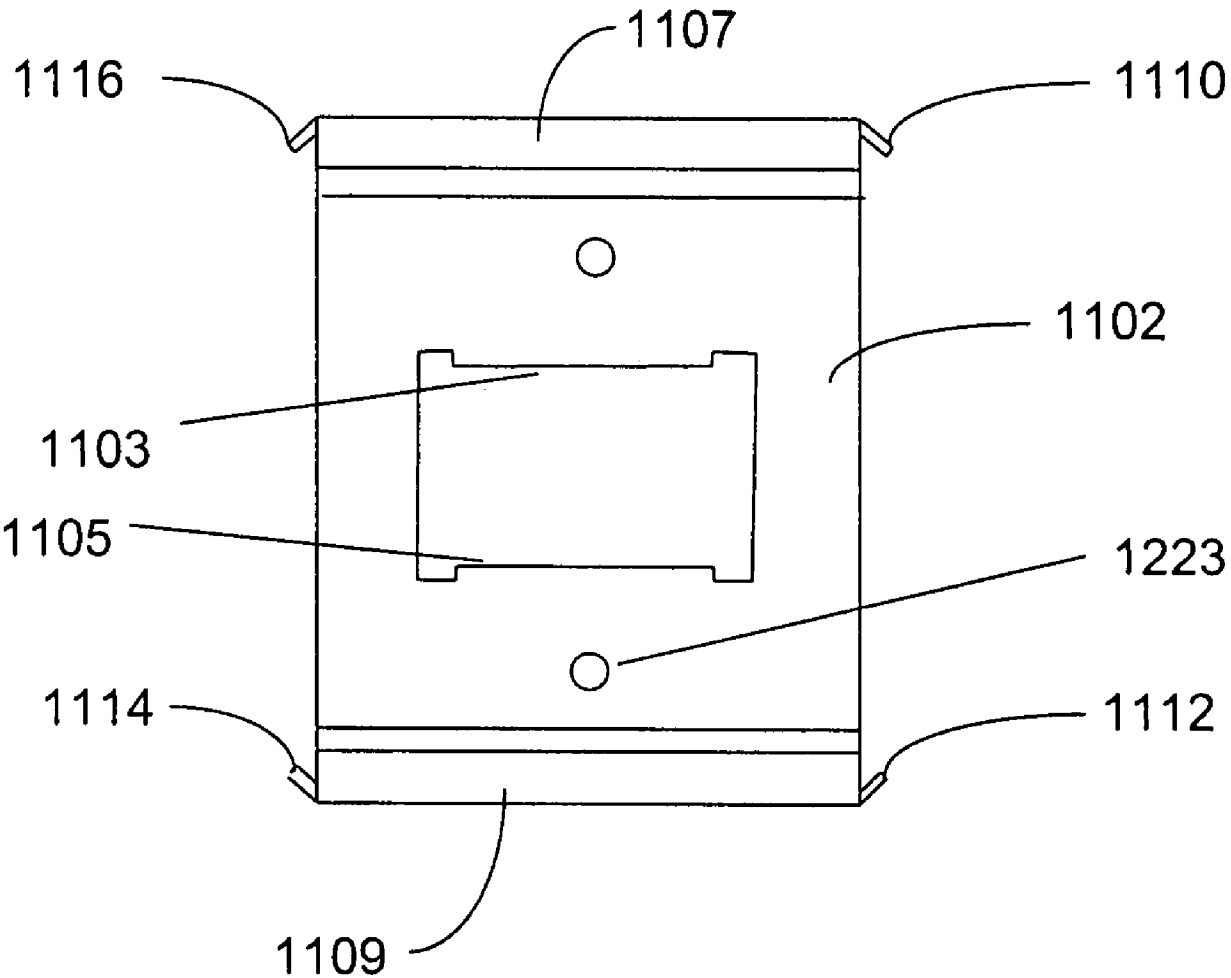
FIG. 12 is an elevation view of the second coupling member portrayed in FIG. 11.

Second side mull coupling member 1100, portrayed in FIGS. 11-12, comprises base plate portion 1102, from which protrude alignment and load transfer tabs 1103 and 1105 in a first direction, and from which protrude spacer portions 1107 and 1109 in a second direction. Referring to FIG. 12, guide tabs 1110, 1112, 1114, and 1116 are attached to spacer portions 1107 and 1109, to act as insertion guides during assembly of compound units. Referring again to FIG. 12, a side elevational view of second mull coupling member 1100 shows a typical length to height aspect ratio of second mull coupling member 1100, as well as screw holes 1223 for attachment to component unit frames.

Figure 13:
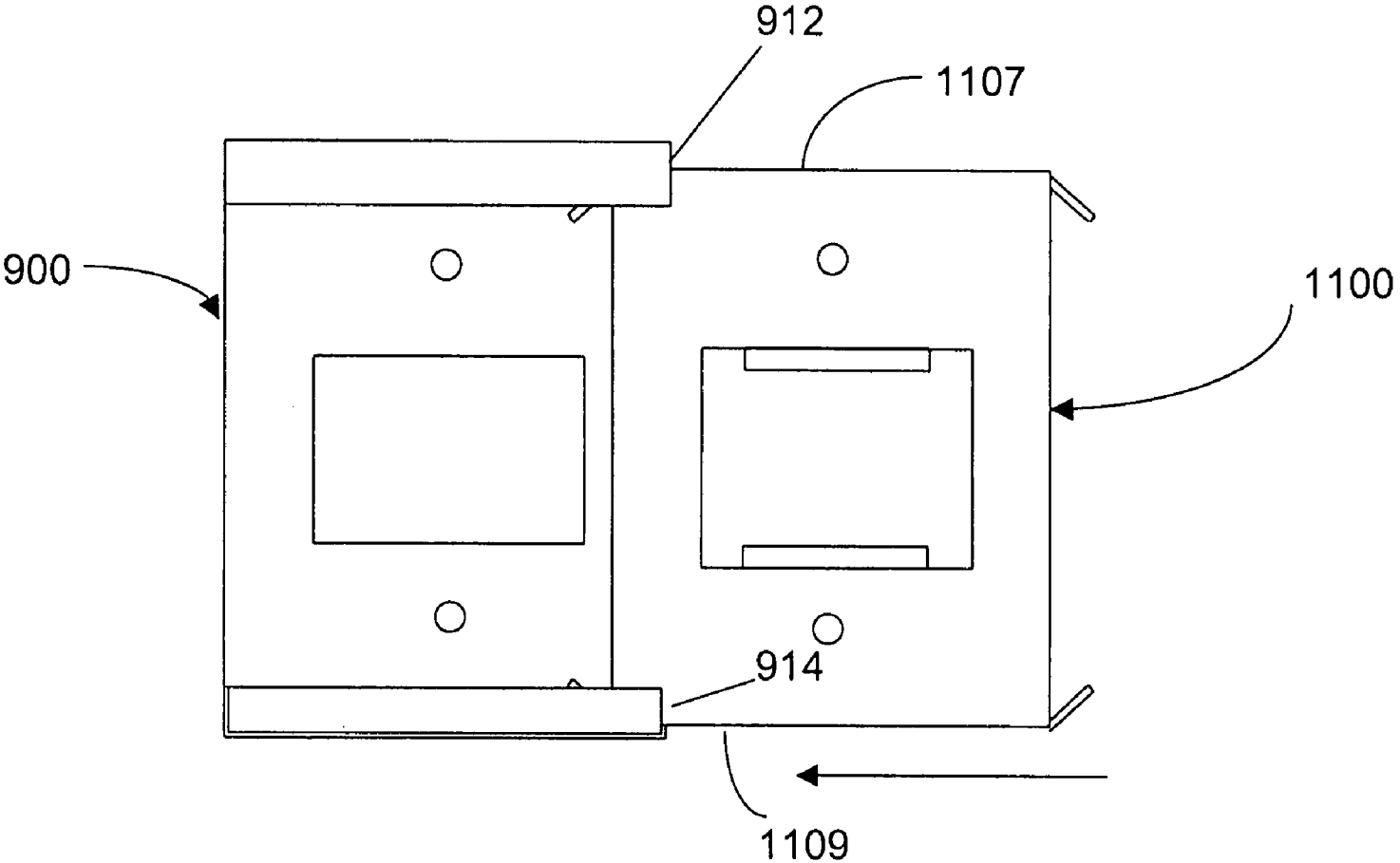
FIG. 13 shows the first and second coupling members portrayed in FIGS. 9-12 positioned for sliding into the coupling position.
Figure 14:
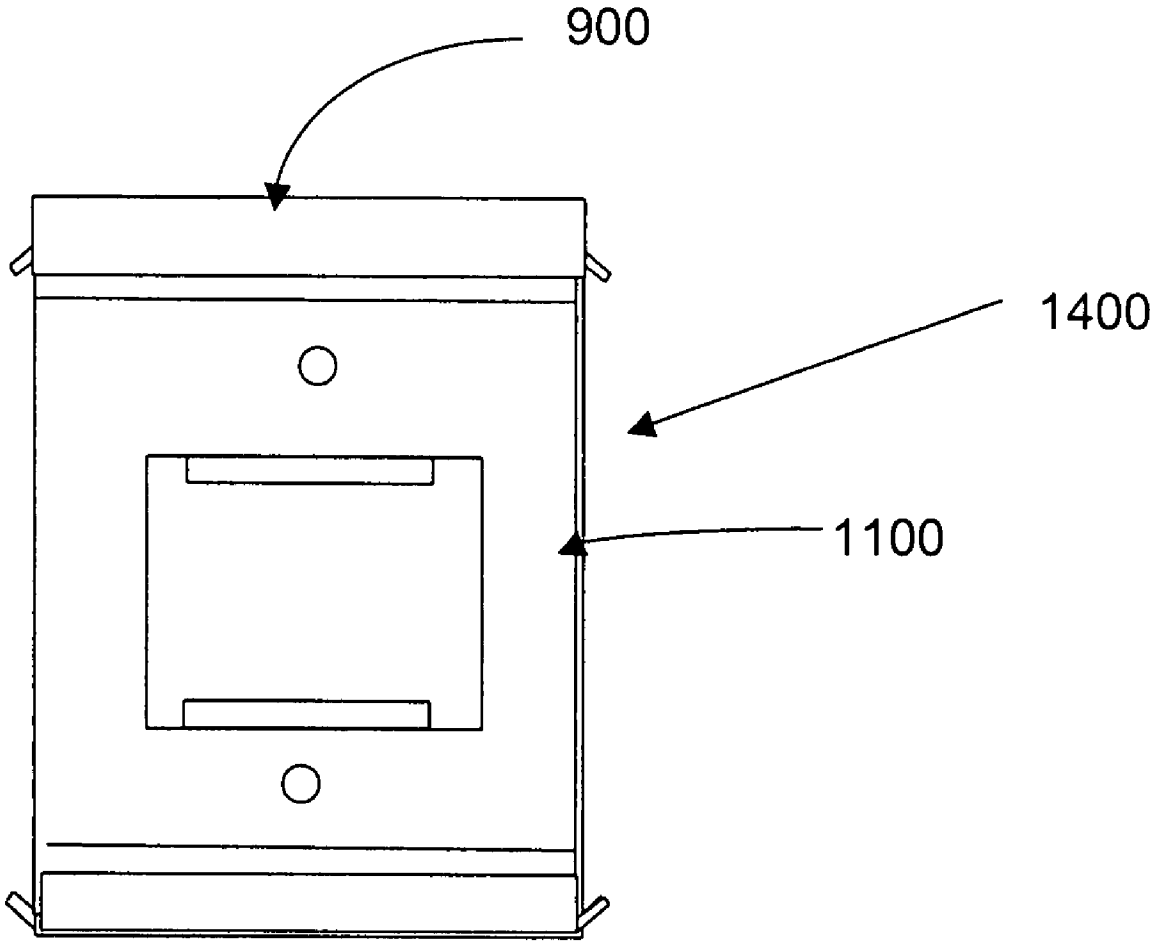
FIG. 14 is an elevation view of the assembled joining system portrayed in FIGS. 9-13.
Figure 15A:
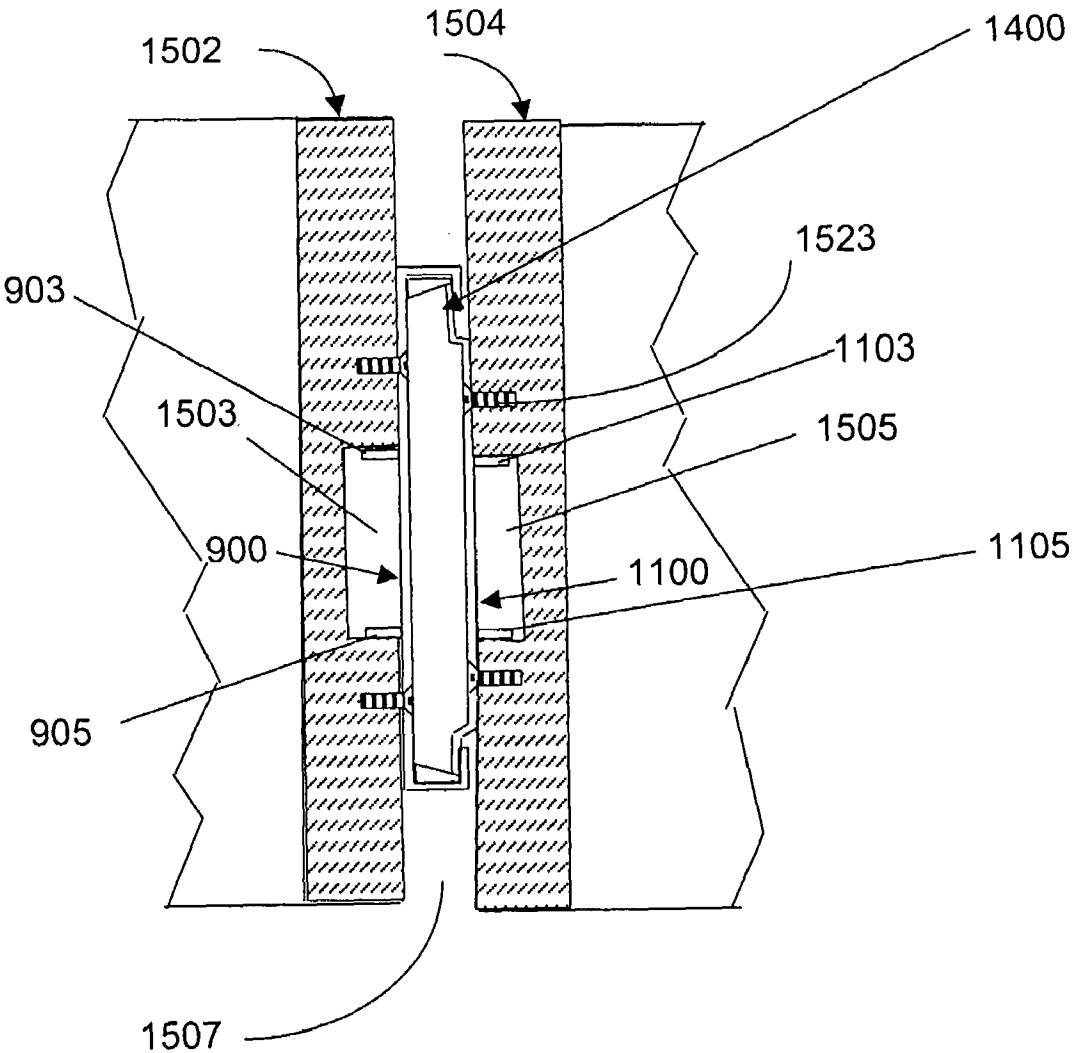
FIG. 15*a* is a cross sectional view of the joint formed by the coupling system portrayed in FIGS. 9-14.

Referring to FIGS. 13 and 14, first coupling tab 1107 and second coupling tab 1109 of second mull coupling member 1100 slide into first channel 912 and second channel 914, respectively, of first mull coupling member 900, to form complete coupling unit 1400, as shown in FIG. 14. FIG. 15*a* shows a cross sectional view of a completed coupling of two component units, wherein first mull coupling member 900 is attached to a first window frame portion 1502, and second mull coupling member 1100 is attached to a second frame portion 1504, with each coupling being located relative to its respective component unit by alignment and load transfer tabs 903 and 905 of first coupling member 900 that fit into channel 1503 of first frame portion 1502 and alignment and load transfer tabs 1103 and 1105 that fit into channel 1505 of second frame portion 1504.

Figure 15B:
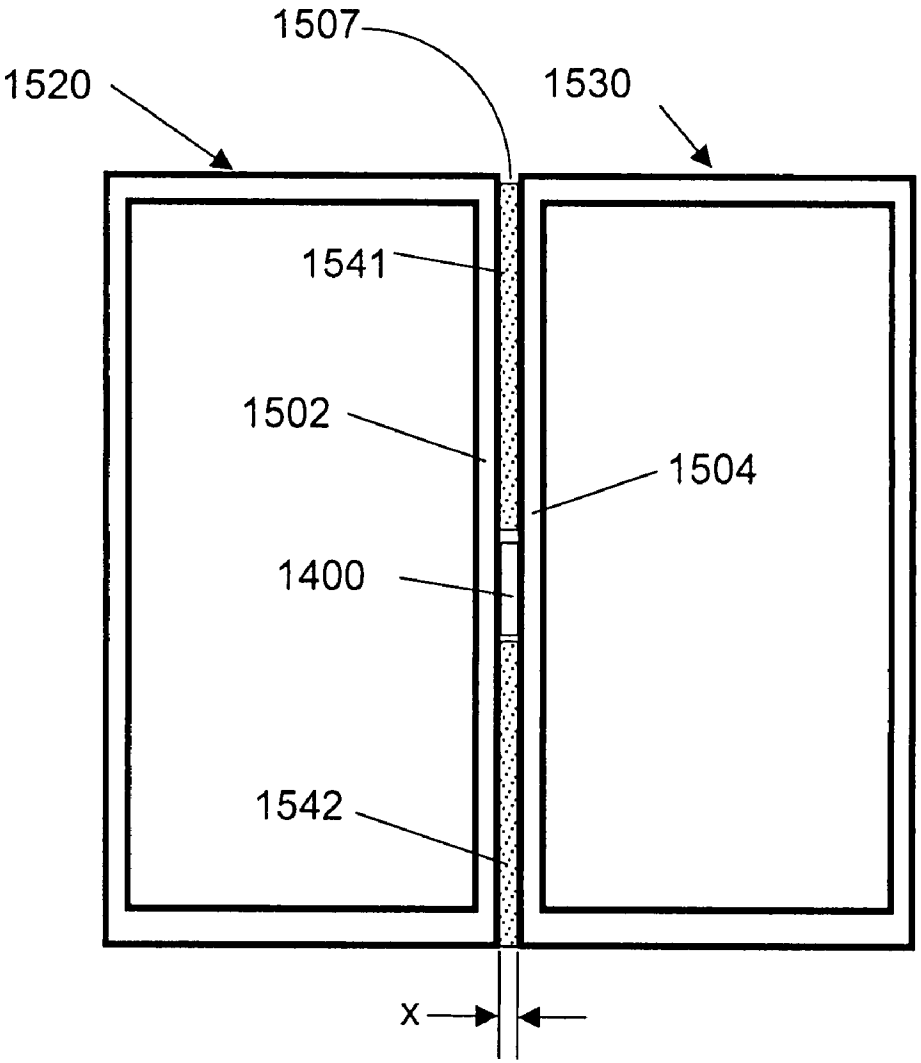
FIG. 15*b* is an elevation view of a compound fenestration unit joined by the joining system portrayed in FIGS. 9-15*a*.

Referring to FIG. 15*b*, gap width x can be controlled more precisely if spacer shims 1541 and 1542 are placed between coupling unit 1400 along gap 1507 between frame portions 1502 and 1504. It is preferred that the thickness of the shims allow a snug to slightly compressed fit between frame portions 1502 and 1504. It will also be apparent that the width of the shims should be chosen so as not to interfere with other components of the compound unit, such as mull sealing strips. Since the spacer shims are only used to maintain spacing x by supporting a relatively small compressive load, and do not serve a coupling function, the choice of suitable materials is relatively wide. Particularly useful materials for the spacer shims are rigid polymeric foams, such as polystyrene or polyurethane foam. Polymeric foams have the additional advantage of being good heat insulators.

Figure 16:
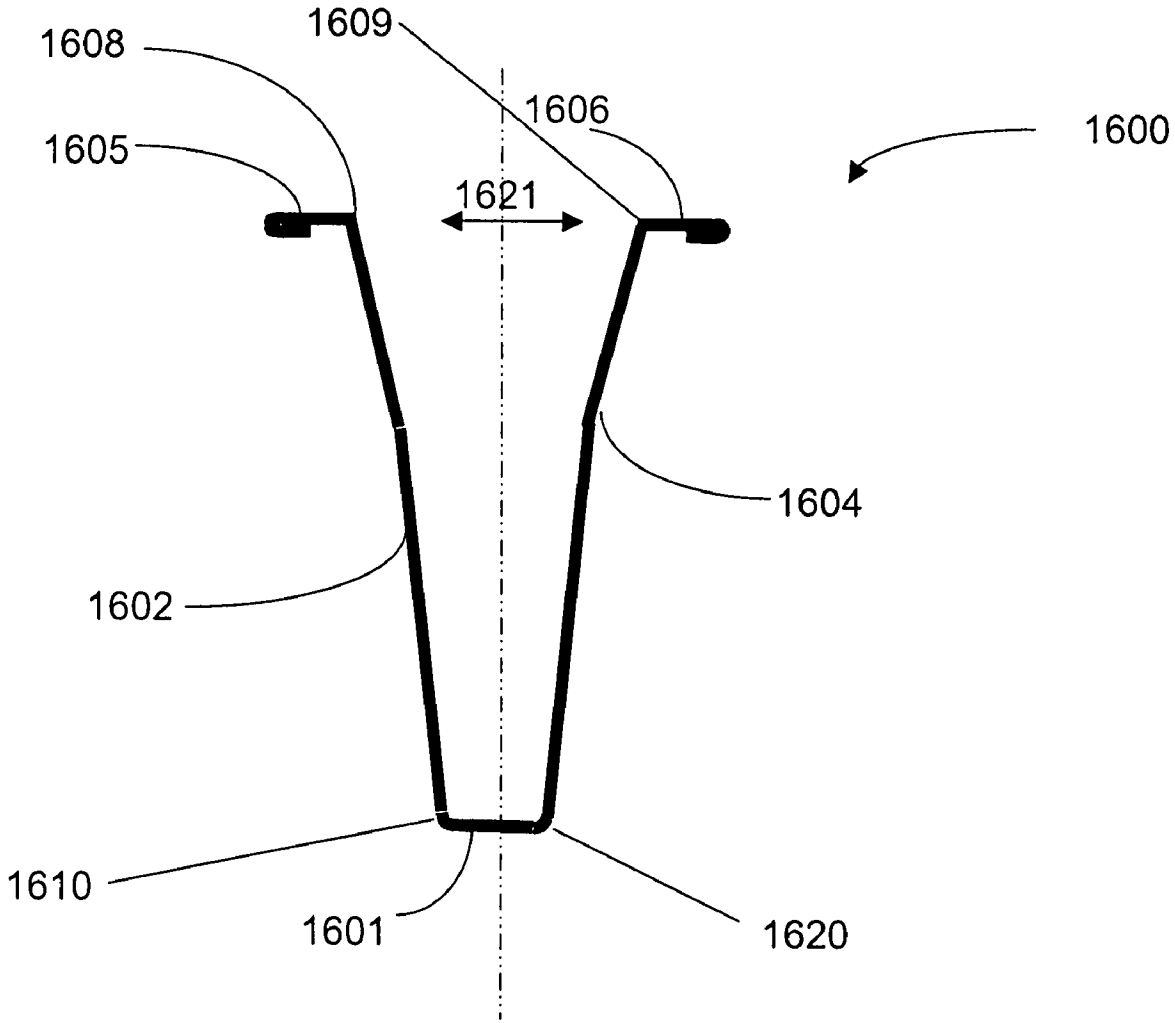
FIG. 16 is a cross sectional view of a backbone portion of an embodiment of a vertical sealing strip according to the present invention.

While the coupling systems disclosed hereinabove enable component units to be mechanically joined into compound glazing units, there is also a need to provide sealing of the joints between the component units against wind, rain, and other intrusions. For this purpose, a system of sealing strips and end seals is provided. In the embodiment shown in FIGS. 16-18, a sealing strip particularly useful for sealing vertical gaps comprises a lineal backbone 1600, having the cross section shown in FIG. 16. Support 1600 comprises base portion 1601 having longitudinal edges 1610 and 1620, to which are attached first leg portion 1602 and second leg portion 1604. Hook portions 1605 and 1606 may further be attached to distal edges 1608 and 1609 of leg portions 1602 and 1604, respectively. Support 1600 is compressible in transverse direction 1621, so that legs 1602 and 1604 can be readily moved toward one another during, for example, installation of the sealing strip. While portions 1601, 1602, 1604, 1605, and 1606 have been described as separate entities, in practice they will typically be made as a single part, by, for example, forming from a sheet metal strip. Sealing at the top and bottom of a mull strip typically depends on the ends of the strip fitting snugly against end sealing components. For this reason, any significant shrinkage in the sealing strip adds to the risk that an end seal may fail, and leakage may occur. It is therefore preferred that support 1600 be made of a low shrink material, such as aluminum, in particular an aluminum alloy such as 5052 alloy, which is formulated for reduced corrosion. A convenient method of making the support portion is to form a strip of aluminum sheet by bending or roll forming.

It is also useful for support member 1600 to be precoated or primed with an adhesion promoting, anti-corrosive, material, such as a chromate pigment in a polymeric binder. Such coatings are commercially available, and their selection and use would be apparent to one of ordinary skill in the art. Polyurethanes are particularly useful as binders for the coating.

It will also be recognized that other backbone materials may provide sufficiently low shrink. For example, pultruded or otherwise reinforced polymeric materials may be suitable in some applications. Also, thermosetting polymeric materials may provide useful reductions in shrink, compared to thermoplastic materials. As will be recognized by one of ordinary skill in the art, the allowable shrink will depend on the ability of the end seals to accommodate dimensional changes without allowing leakage. Therefore, suitable shrinkage levels are those that are sufficiently low to be effective in maintaining the seals at the ends of the sealing strip, for the type of end seals being used, under conditions normally encountered by fenestration units.

The present invention utilizes a dual sealing system, comprising exterior, or shielding seals, and interior, or pressure seals. The spaces between the exterior and interior seals will be referred to as interseal cavities. The interseal cavities have openings that allow drainage and ventilation, but which are shielded from direct wind. The interseal cavities serve as quiescent dry zones where, under conditions of wind and rain, only a limited amount of rain water enters, due to the shielding effects of the shielding seals and other shielding devices covering the openings. The pressure seals, on the other hand, are complete seals that seal the interseal cavities from the interior of the building. Since the interseal cavities contain little or no water, any leakage of the pressure seals is likely be leakage of air only, which would be unlikely to harm the interior of the building. Moreover, since the pressure seals are protected from weathering and mechanical damage by the shielding seals, the effectiveness of the pressure seals is likely to remain high over an extended period of time.

Figure 17:
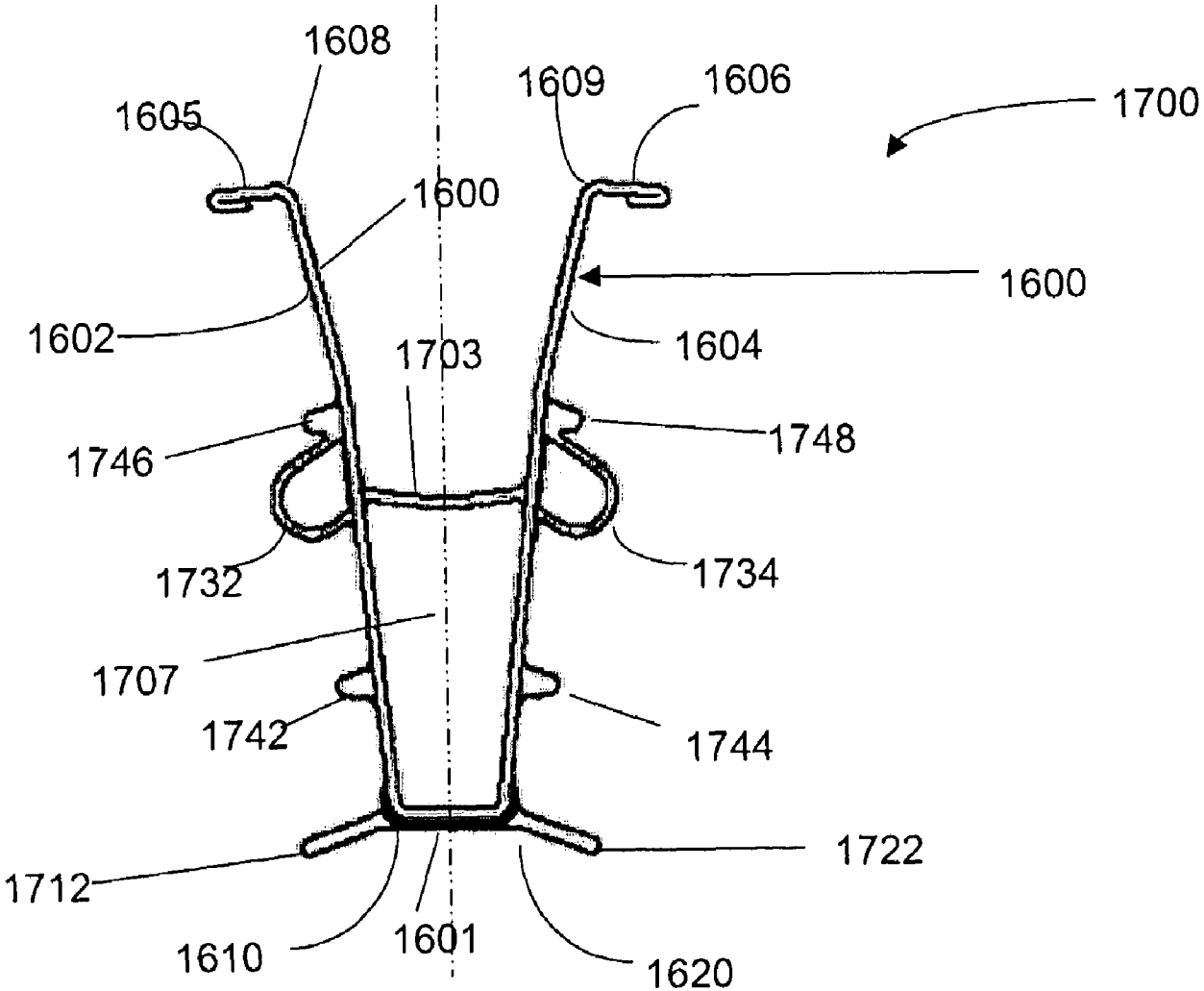
FIG. 17 is a cross sectional view of an embodiment of a vertical sealing strip.

Referring to FIG. 17, a dual sealing system comprising several conformable seals attached to support member 1600 is portrayed. Shielding fins 1712 and 1722 are attached to support 1600 at longitudinal edges 1610 and 1620. Pressure seals 1732 and 1734 are attached to legs 1602 and 1604, respectively. It has been found useful to make seals 1732 and 1734 tubular in cross section and somewhat inclined toward the exterior side, for ease of installation of sealing strip 1700, combined with effective sealing. Sealing strip 1700 further comprises cross member 1703, which divides it into an exterior portion and an interior portion. The exterior portion of sealing strip 1700, that is to say the portion facing the exterior of the structure in which the compound unit is installed, is the portion of the sealing strip between base portion 1601 and cross member 1703, while the interior portion is the portion facing the interior of the structure, that is to say the portion between cross member 1703 up to and including hook portions 1605 and 1606. Cross member 1703, base portion 1601, and the portions of legs 1602 and 1604 between cross member 1703 and base portion 1601 collectively define cavity 1707, which is open at the bottom end to allow any water that may be present to be conveyed to a harmless exterior location. Centering and consistent compression of sealing strip 1700 in the gap to be sealed is aided by ribs 1742 and 1744, as well as by ribs 1746 and 1748.

Figure 18:
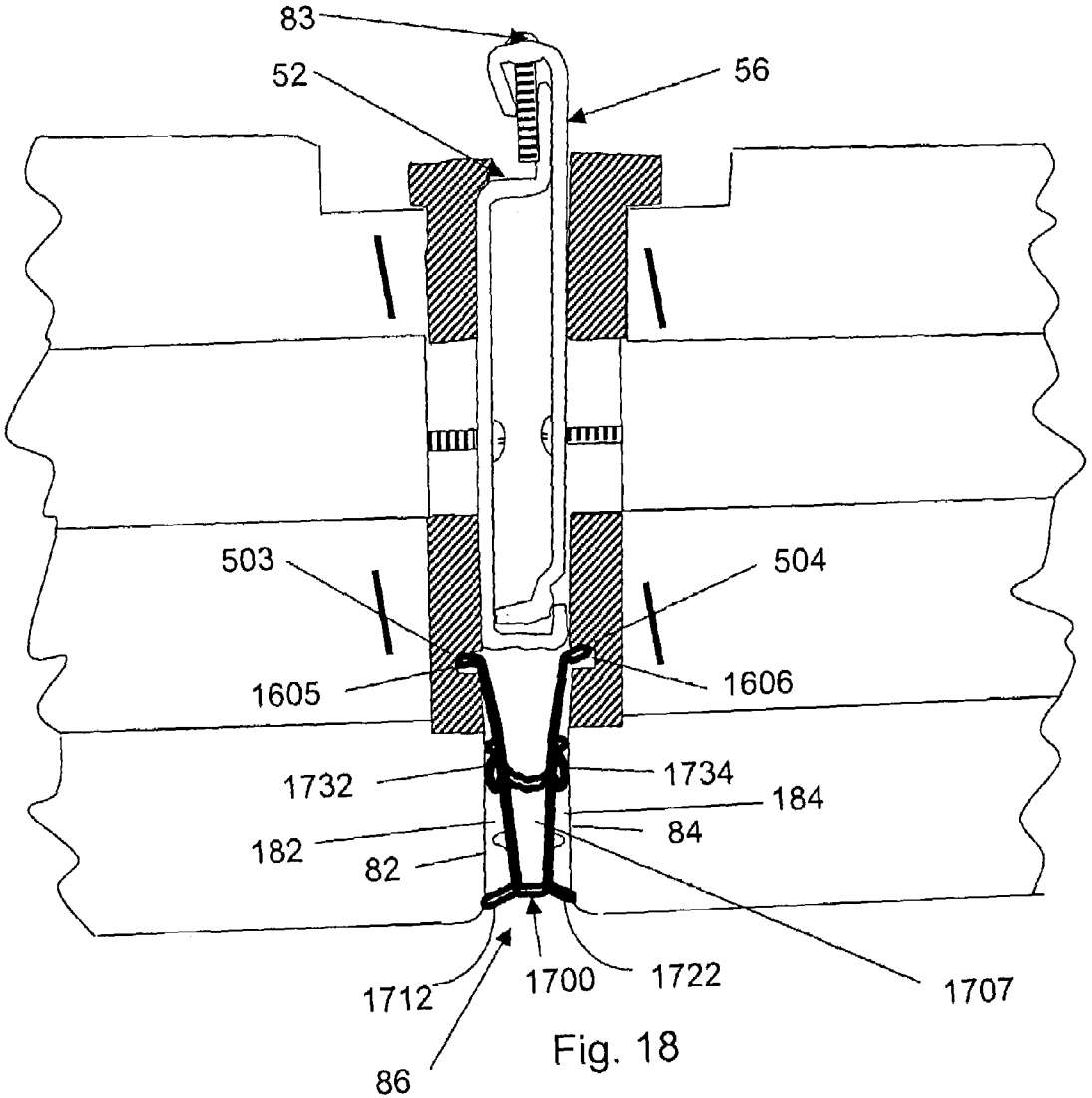
FIG. 18 is a cross sectional view of a joint in a compound fenestration unit sealed by the sealing strip portrayed in FIG. 17.
Figure 25A:
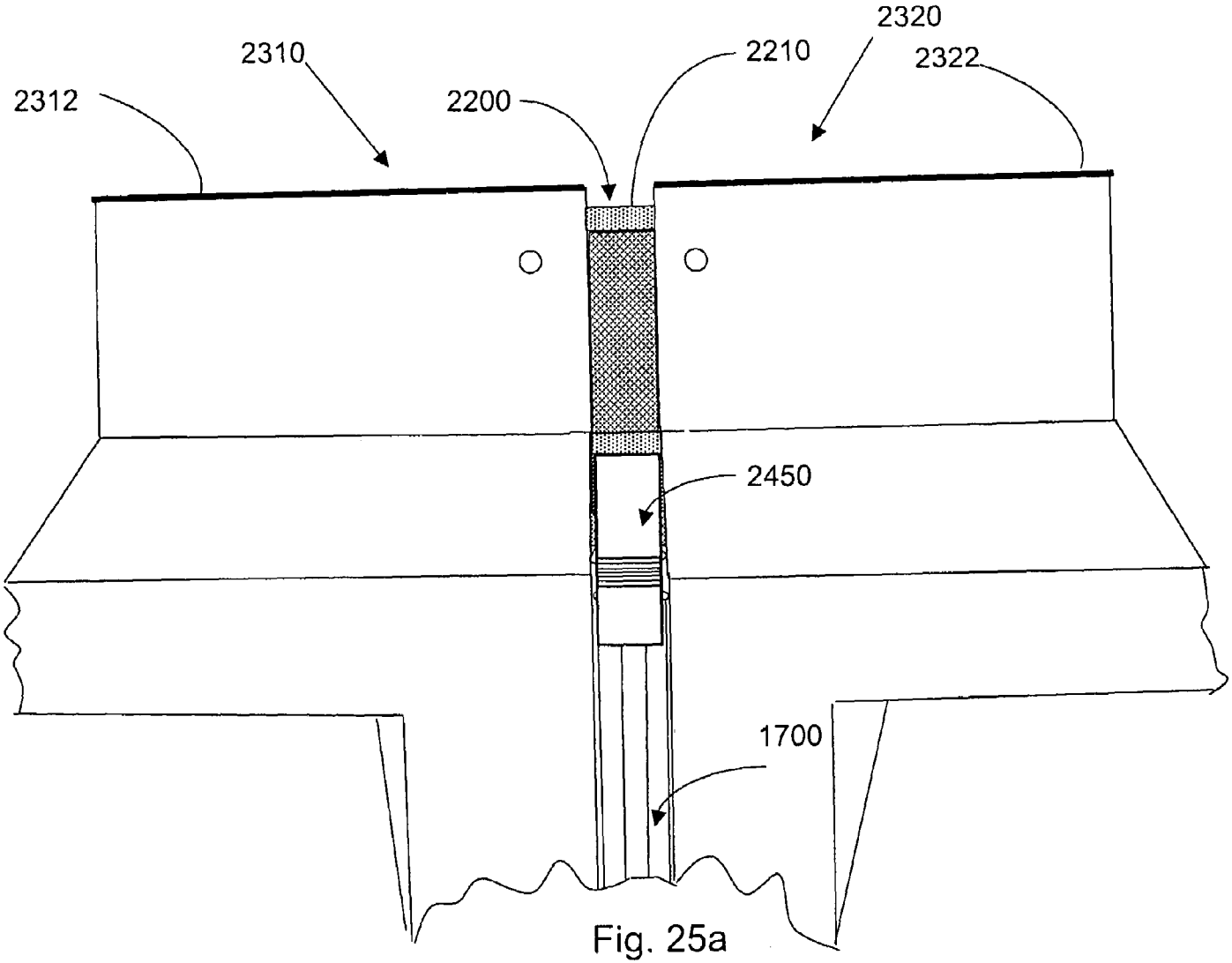
FIG. 25*a* is a compound fenestration unit utilizing the end cover portrayed in FIG. 24 to seal the top end of a vertical sealing strip.
Figure 25B:
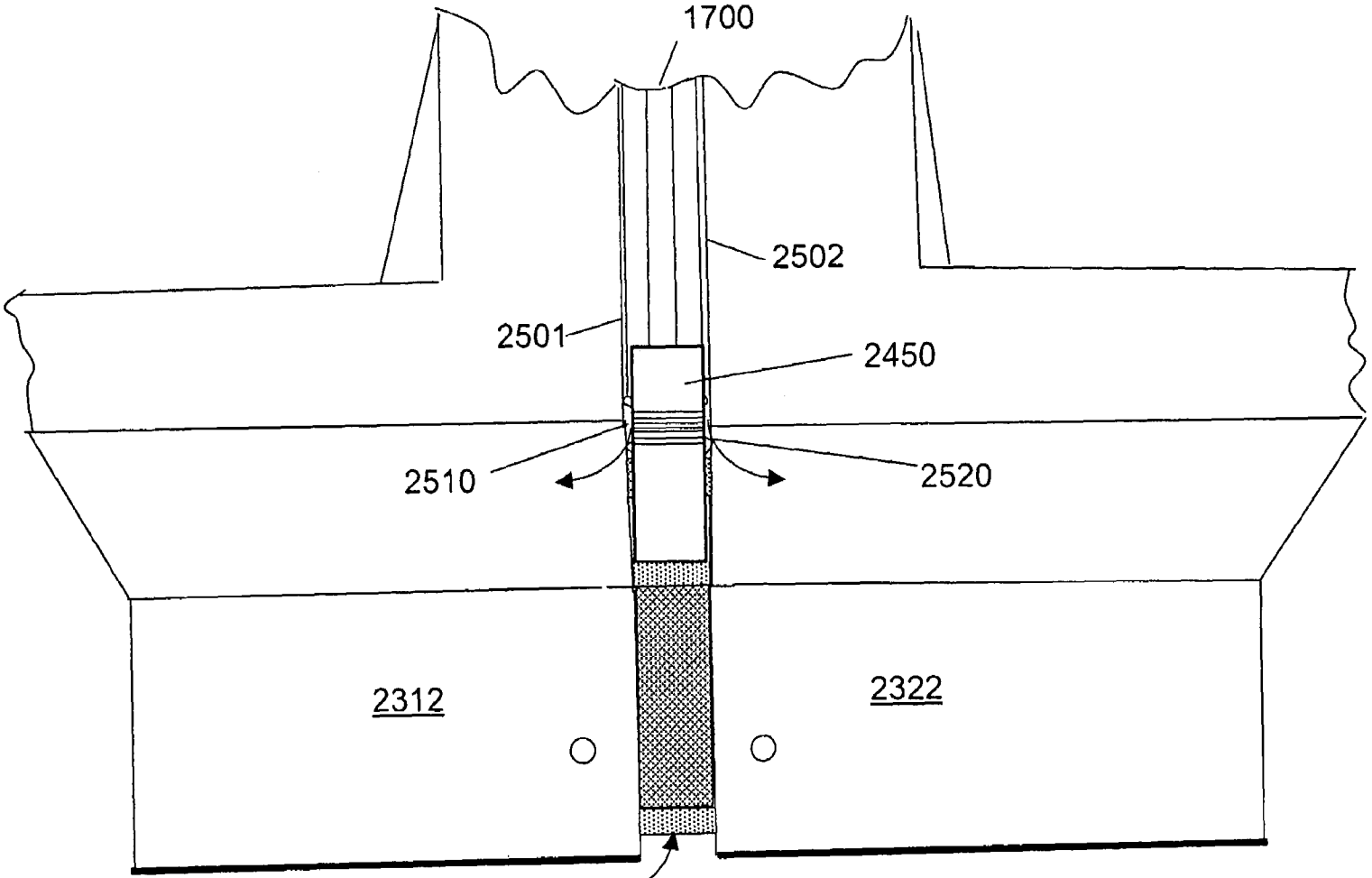
FIG. 25*b* is a compound fenestration unit utilizing the end cover portrayed in FIG. 24 for sealing the bottom end of a vertical sealing strip.

Referring to FIG. 18, sealing strip 1700 is installed in gap 86, with hooks 1605 and 1606 engaging kerfs 503 and 504. Kerfs 503 and 504 provide stops for strip 1700, and help to orient it relative to gap 86. Kerfs 503 and 504 also provide additional assurance that strip 1700 will not be unintentionally removed from gap 86. Shielding fins 1712 and 1722 fit against sealing faces 82 and 84, respectively, to form a shielding seal. Inner seals 1732 and 1734 also fit against sealing faces 82 and 84, respectively, to form a pressure seal, thereby forming interseal cavities 182 and 184. Interseal cavities 182 and 184, as well as cavity 1707, are able to drain any water that may be present to a harmless location. They may also be ventilated at the top by shielded ventilated apertures. The seals formed by fins 1712 and 1722, along with the various shielding components at the top and bottom ends, are often sufficient to prevent leakage. However, under some conditions, such as severe cases of wind and rain, some water may enter interseal cavities 182 and 184. Since the air in cavities 182 and 184 can be expected to be relatively quiescent, however, any leaked water is likely to drop to the bottom of these cavities, where it can drain out through openings 2510 and 2520, as shown in FIG. 25*b*. Pressure seals 1732 and 1734 perform the primary sealing function, since the primary part of the pressure drop from exterior to interior occurs across these seals. Since there is expected to be relatively little airborne water in cavities 182 and 184, however, any leakage past these seals is likely to be primarily leakage of air. Moreover, since seals 1732 and 1734 are protected from direct sunlight, as well as from mechanical damage, it is expected that these seals will maintain a high level of reliability.

A useful method for producing sealing strip 1700 is to feed formed backbone 1600 through an extrusion die so as to extrude shielding fins 1712 and 1722, along with pressure seals 1732 and 1734, cross member 1703, and centering ribs 1742, 1744, 1746, and 1748 onto the support. Since shielding fins 1712 and 1722 present visible surfaces when installed, it is useful for them to have a color that is compatible with the units being sealed. Likewise, since base area 1601 between fins 1712 and 1722 is also visible, it is also useful to cover it with extruded material of a similarly suitable color.

After extrusion of the polymeric material onto support 1600, the resulting extruded stock material is cut to length. The length of vertical mull sealing strips is typically less than the height of the window by an amount sufficient to allow insertion of a compressed end seal at each end, while still maintaining compression of the end seal.

Figure 19:
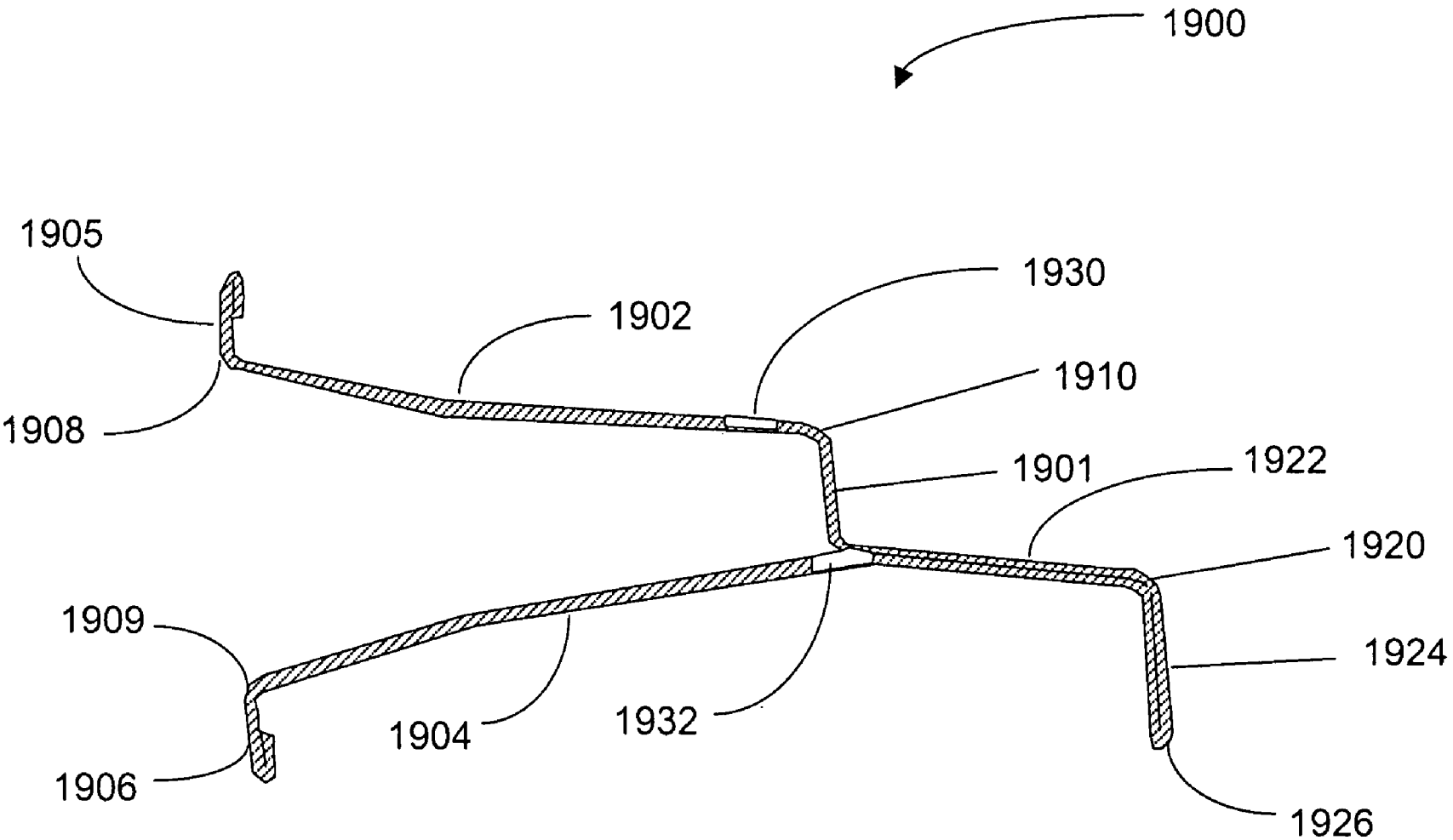
FIG. 19 is a cross sectional view of a backbone portion of an embodiment of a horizontal sealing strip.

While sealing strip 1700 has been found effective for sealing vertical gaps in compound fenestration units, an alternative sealing strip, comprising a low shrink backbone portion and conformable sealing portions, along with a drain ramp and drip edge, has been found especially effective for sealing horizontal gaps, while also helping to divert water away from areas of possible leakage. Referring to FIG. 19, sealing strip backbone portion 1900 comprises first vertical wall 1901, from which extend top leg portion 1902 and bottom leg portion 1904 in a first, interior, direction, and from which extends drain ramp 1922 in a second, exterior, direction. Additionally, top anchoring hook portion 1905 is attached to distal edge 1908 of top leg portion 1902, and bottom anchoring hook portion 1906 is attached to distal edge 1909 of bottom leg portion 1904. A second, lower, wall 1924 is attached to drain ramp 1922 at its distal edge 1920. Wall 1924 terminates at drip edge 1926. A series of drain holes 1930 and 1932 are also provided to enable diversion of leaked water to a harmless location such as the exterior side of the window unit.

Figure 20:
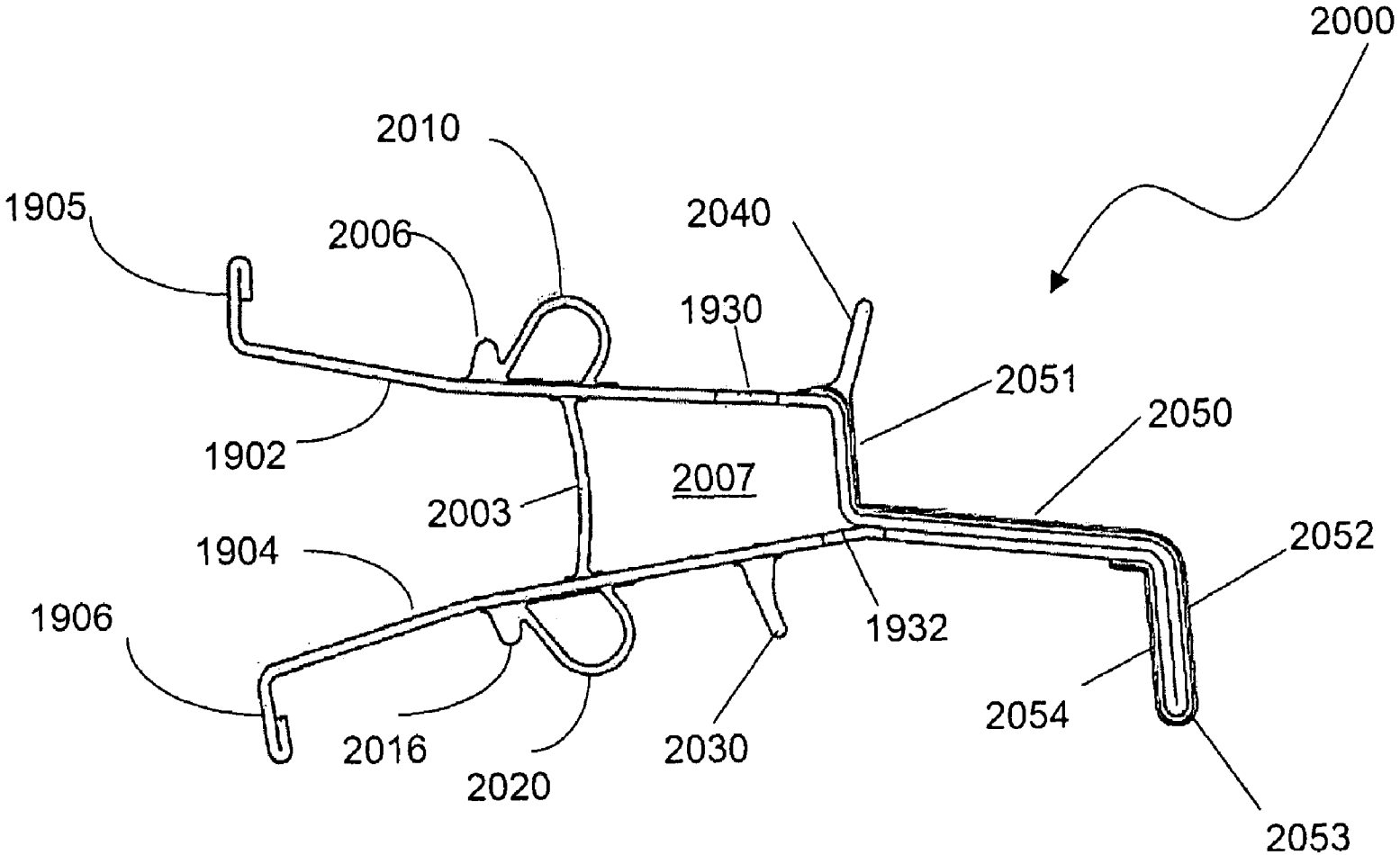
FIG. 20 is cross sectional view of an embodiment of a horizontal sealing strip.
Figure 21:
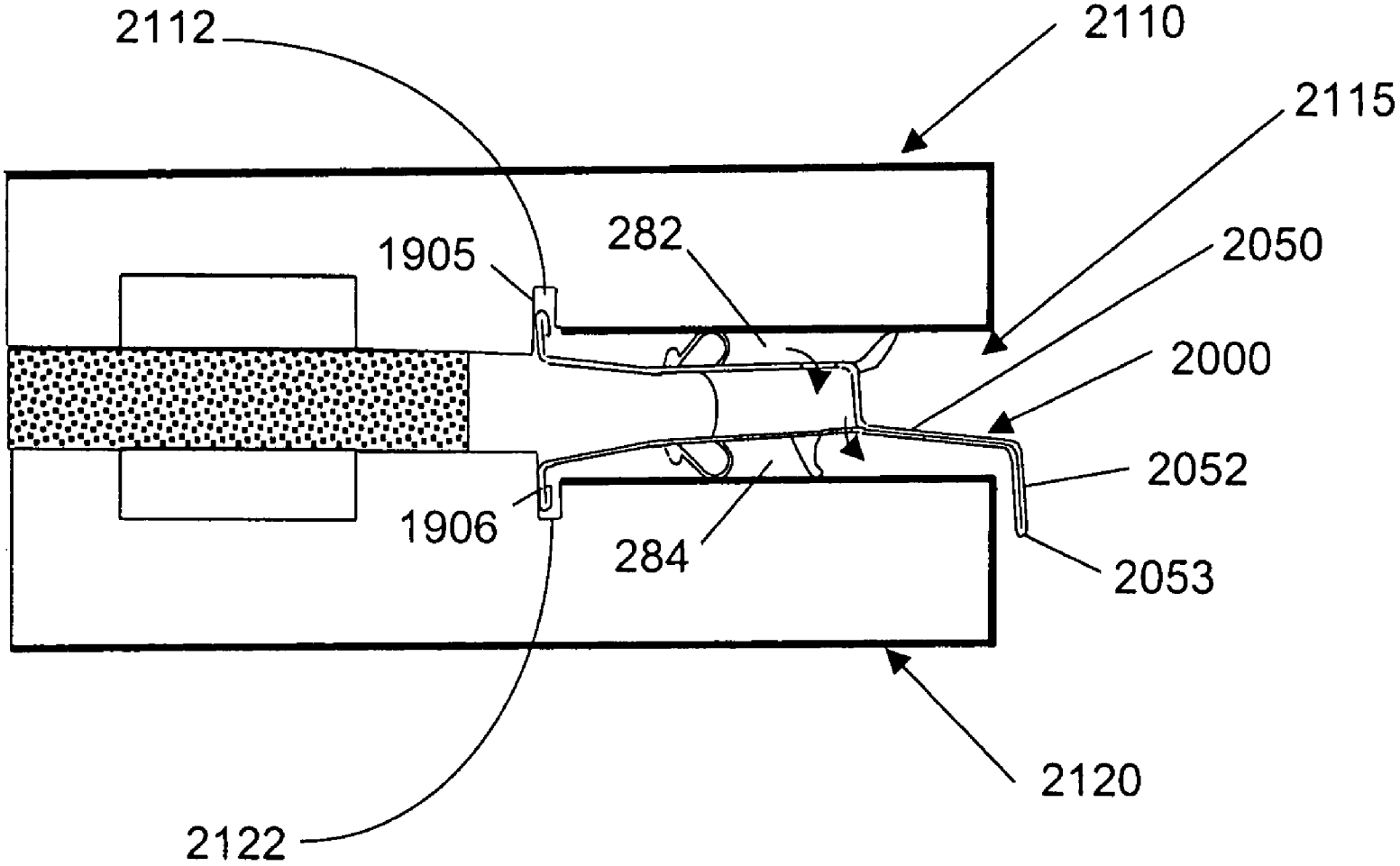
FIG. 21 is a cross sectional view of a horizontal joint sealed with the sealing strip portrayed in FIG. 20.

Referring to FIGS. 20 -21, top shielding fin 2040 and bottom shielding fin 2030 provide shielding against wind and rain, while interior pressure seals 2010 and 2020 provide the primary sealing against leakage due to pressure differentials. Referring to FIG. 21, interseal cavities 282 and 284 provide dry quiescent zones that enable collection of any water that may have leaked past shielding fin 2040. Drain holes 1930 and 1932 allow water to drain to a harmless location, such as the exterior of the structure in which the unit is installed. Drain ramp portion 2050 and vertical wall portion 2052 serve to divert rain or other water to drip edge 2053, where it can fall to the ground or to other harmless locations. Since surfaces 2050, 2051, and 2052 are visible surfaces, it is useful to also coat these surfaces with a suitably colored polymeric material. As shown in FIG. 21, horizontal sealing strip 2000 is used to seal horizontal gap 2115 between upper component unit 2110 and lower component unit 2120. Kerfs 2112 and 2122 are provided for receiving hooks 1905 and 1906, so as to assure that sealing strip 2000 is inserted to the proper distance during installation and that it is secured in place after installation.

Figure 22:
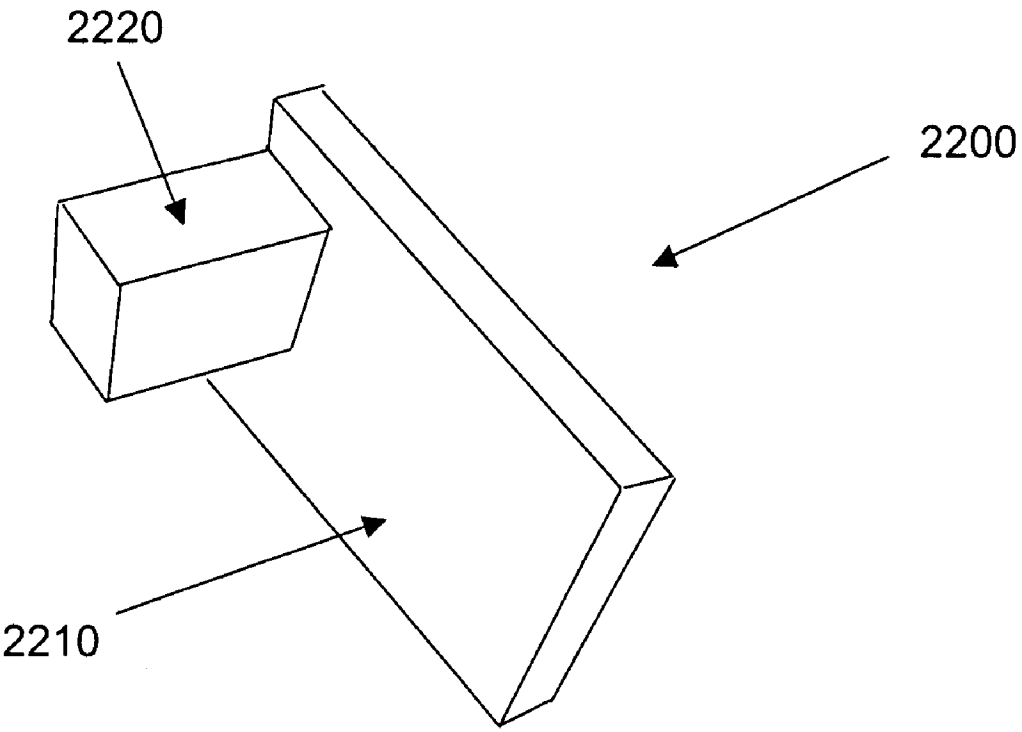
FIG. 22 is an embodiment of a sealing component for sealing ends of gaps between component units, and for sealing gaps between nailing flanges in compound fenestration units.

While vertical sealing strips 1700 and horizontal sealing strips 2000 can be effective in sealing gaps, it will be recognized that ends of gaps and junctions of gaps will inevitably occur in compound fenestration units. Moreover, gaps in nailing flanges between component units also occur. Referring to FIG. 22, a seal for sealing the ends of gaps, along with gaps in nailing flanges, is portrayed. Seal 2200 is made of a conformable foam material and comprises flange gap sealing portion 2210 and gap filler portion 2220. Seal 2200 can be produced by any suitable means, such as cutting from a solid block of foam, or by adhering suitably dimensioned strips of foam together, as would be apparent to one skilled in the art. It has been found that seal 2200 is more effective in its sealing function if the surface skinning effect commonly encountered in molding of foams can be avoided, so that the porosity of the foam found in the interior of the part also extends to the surface. A useful polymeric material for the foam is EPDM polymer. In addition, it has been found that lubricating the surface of the foam seal with an inert lubricant such as talc prior to installation is useful in easing installation and enabling the foam to properly seat so as to form an acceptable seal.

Figure 23:
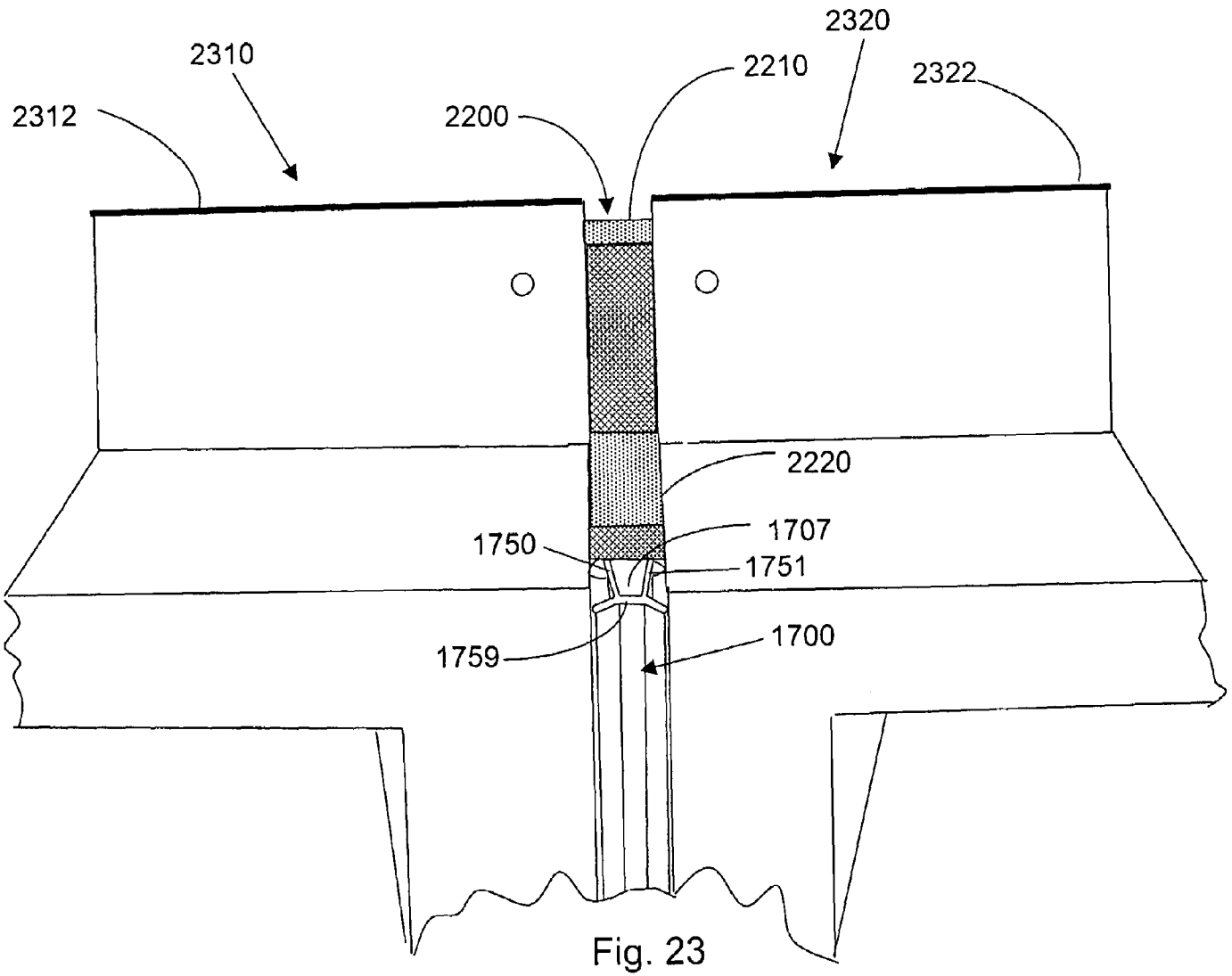
FIG. 23 is a compound fenestration unit utilizing the sealing component portrayed in FIG. 22.
Figure 24:
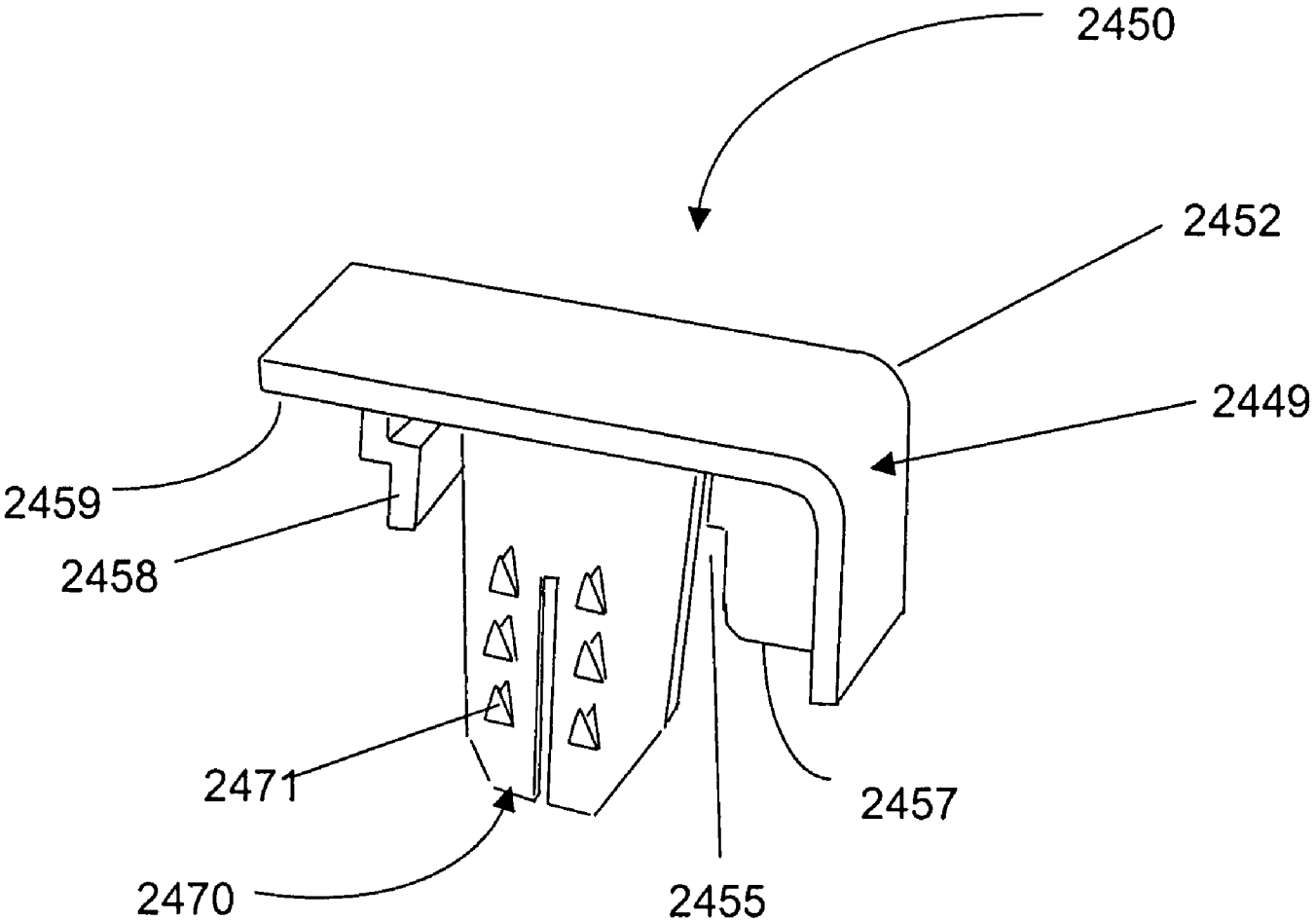
FIG. 24 is an end cover for a vertical sealing strip.

Referring to FIG. 23, seal 2200 is shown installed at the top end of vertical sealing strip 1700, where it cooperates with the top ends of the pressure seals of strip 1700, and also fills the gap between nailing flanges 2312 and 2322. An end cover, portrayed in FIG. 24, is installed in cavity 1707 to compress gap filler portion 2220 against gap sealing strip 1700 to form a more secure seal and to cover cavity 1707, while allowing ventilation of cavity 1707.

Referring again to FIGS. 23 and 24, top end cover 2450 is comprised of cover portion 2449 and barbed retainer clip portion 2470. Cover 2450 is installed by inserting clip portion 2470 into cavity 1707 and pressing down until stop rib 2458 engages surface portion 1750 of strip 1700, and locator notch 2455 of rib 2457 engages surface portion 1759 of strip 1700. As a result, end portion 2459 of cover 2450 compresses gap filler portion 2220 of foam seal 2200 against the ends of pressure seals 1732 and 1734, thus completing the pressure seal at the top end, while still allowing ventilation of the interseal cavities and cavity 1707, as shown in FIG. 25*a*. Compression of filler portion 2220 is maintained by engagement of barbs 2471 with the interior surfaces of cavity 1707 of sealing strip 1700. Referring again to FIG. 25*a*, it will be noted that the width of cover 2450 is slightly less than the spacing between component units 2310 and 2320, so as to leave gaps between sealing faces 2501 and 2502 and cover 2450, which allow ventilation of cavity 1707, and of interseal cavities 182 and 184.

Referring to FIG. 25*b*, cover 2450 can also be used, along with foam seal 2200, at the bottom end of vertical sealing strip 1700. Since cover 2450 is slightly narrower than the gap between sealing faces 2501 and 2502, drain openings 2510 and 2520 are created, which allow drainage of leaked water from cavity 1707 and interseal cavities 182 and 184.

Figure 26:
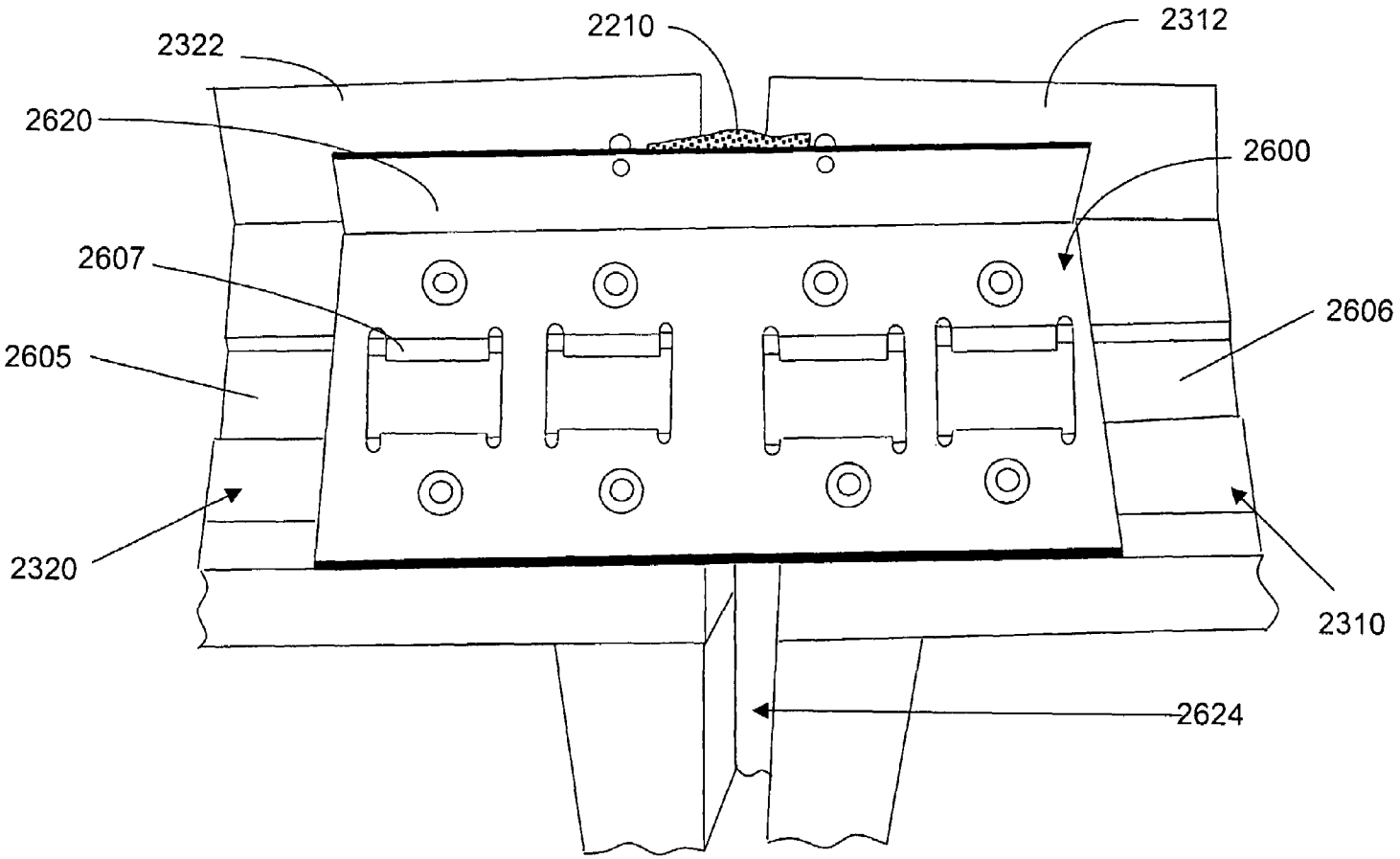
FIG. 26 is a view of a portion of a compound fenestration unit comprising a gusset plate.

Referring to FIG. 26, the structural strength of the compound fenestration unit can be further enhanced by providing gusset plates such as plate 2600. Plate 2600 can be made from stamped and bent sheet metal, such as steel. Tabs 2607 engage channels 2605 and 2606 in component units 2310 and 2320, respectively, to position plate 2600 relative to component units 2310 and 2320, as well as to position units 2310 and 2320 relative to one another. Additionally, tabs 2607 strengthen the mechanical coupling of plate 2600 to component units 2310 and 2320. Backup tab 2620 reinforces the attachment of the compound unit to the building structure, and also sandwiches flange gap sealing portion 2210 so as to enhance sealing at the gap between nailing flanges 2312 and 2322. It will be appreciated that when the compound fenestration unit is installed in a rough opening, screws inserted through holes 2315 serve to not only hold the compound unit in place, but also serve to compress portion 2210 of seal 220 for improved sealing reliability.

Figure 27A:
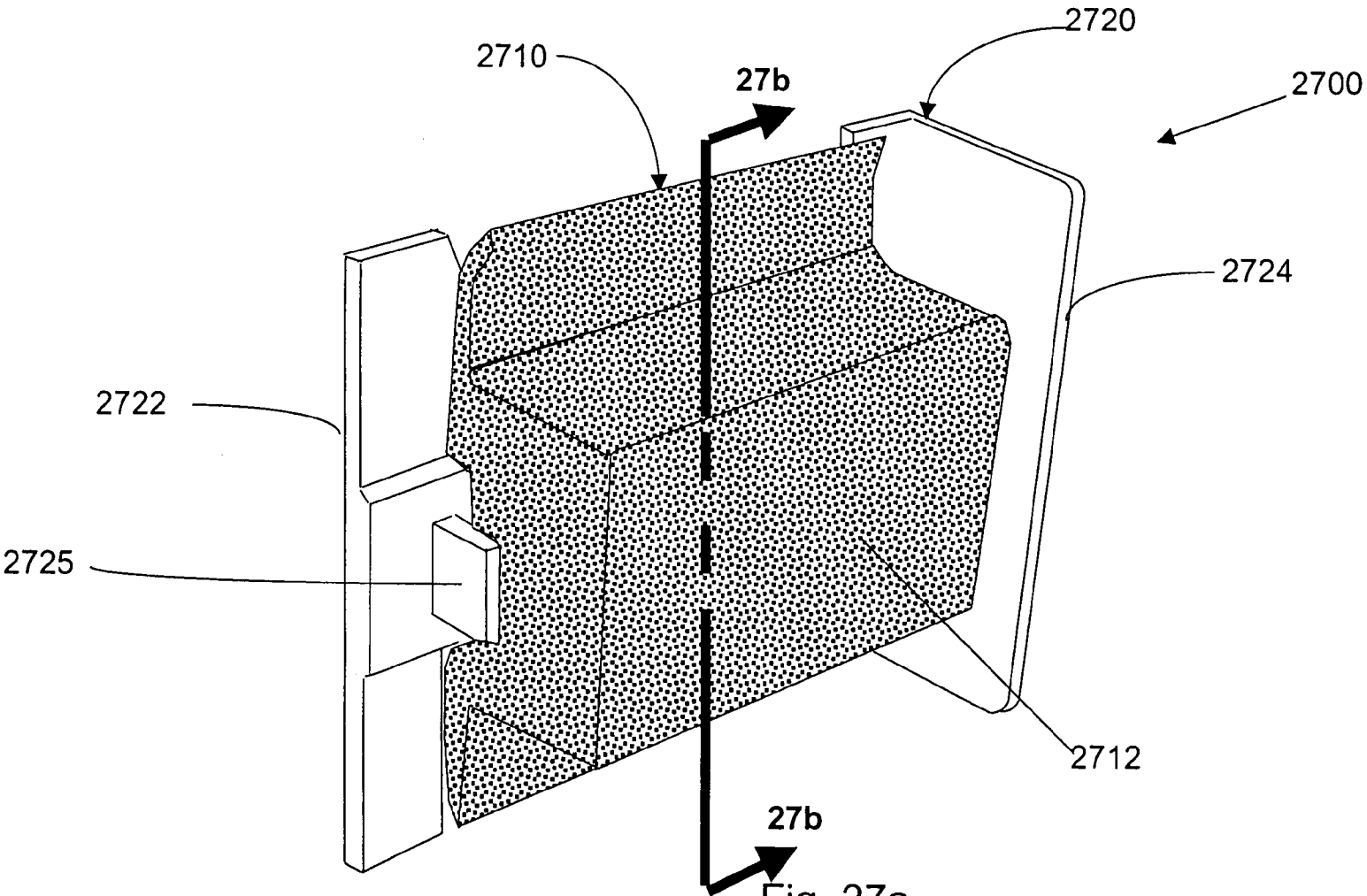
FIG. 27*a* is an embodiment of a junction seal for sealing junctions in gaps in a compound fenestration unit.
Figure 27B:
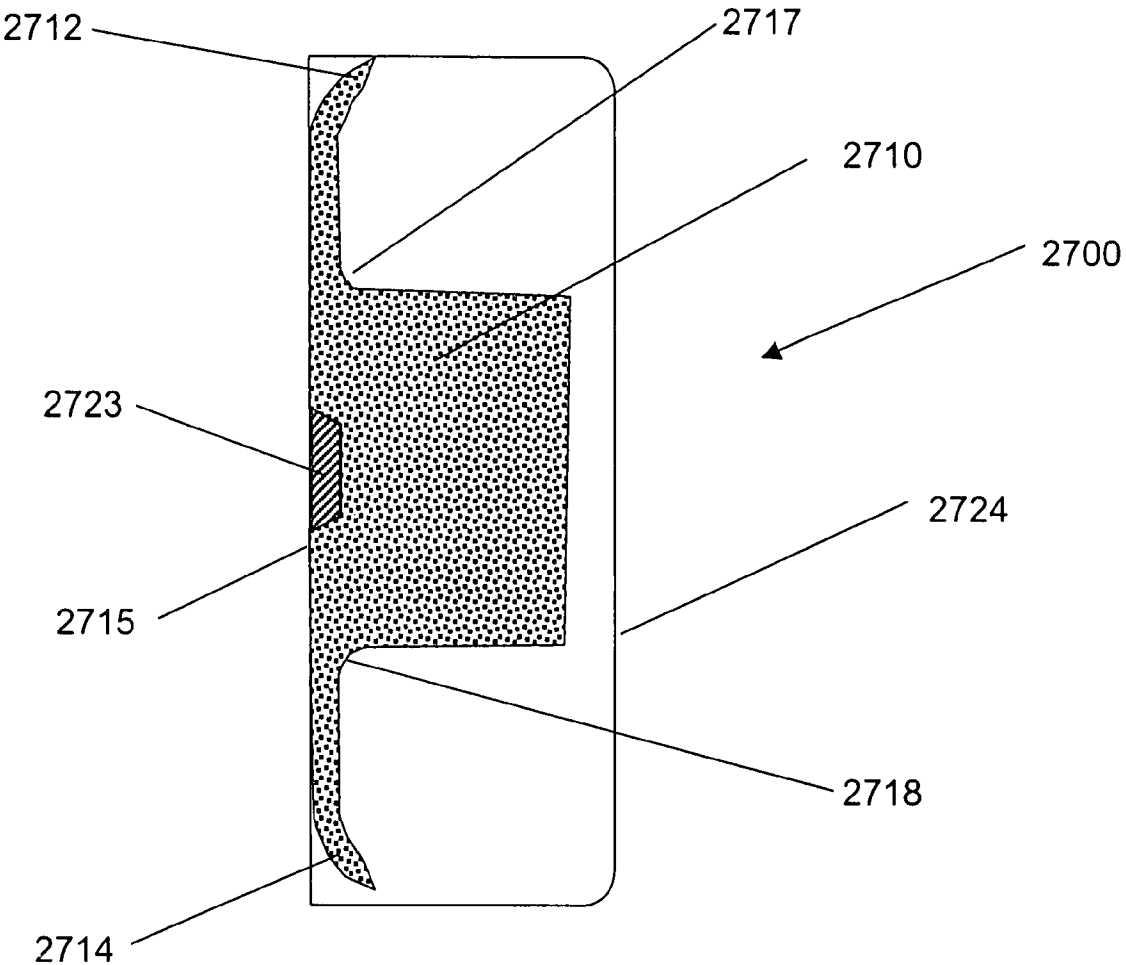
FIG. 27*b* is a cross sectional view of the junction seal portrayed in FIG. 27*a*.

Junctions of horizontal gaps and vertical gaps, such as junction 9 in FIG. 1, also require sealing. An embodiment of a junction seal is portrayed in FIGS. 27*a* and 27*b*. Junction seal 2700 comprises a conformable sealing portion 2710 that is attached to support portion 2720. A suitable conformable material is polymeric foam, made, for example, by foaming EPDM polymer. Support portion 2720 comprises backbone portion 2723, which connects front trim portion 2724 with rear base portion 2722, to which is attached anchoring tab 2725. It has been found that the sealing effectiveness of conformable portion 2710 can be enhanced by certain shape features. In particular, edges 2712 and 2714 are made as thin as possible, to provide a smooth transition with the sealing face of the fenestration unit, thereby allowing other sealing surfaces, such as pressure seal 2020 of sealing strip 2000 and shielding seal 2030 to fit over them without voids in the sealing area. In addition, the trapezoidal shape of backbone portion 2723 allows conformable portion 2710 to conform to it and thus provide a relatively seamless, void free, transition between surface 2715 of conformable material 2710 and surface 2725 of backbone 2723. It will be appreciated that cross sectional shapes other than trapezoidal for backbone 2723 may also be suitable, provided that they promote a smooth and void-free conformance of material 2710 to the backbone.

Figure 28:
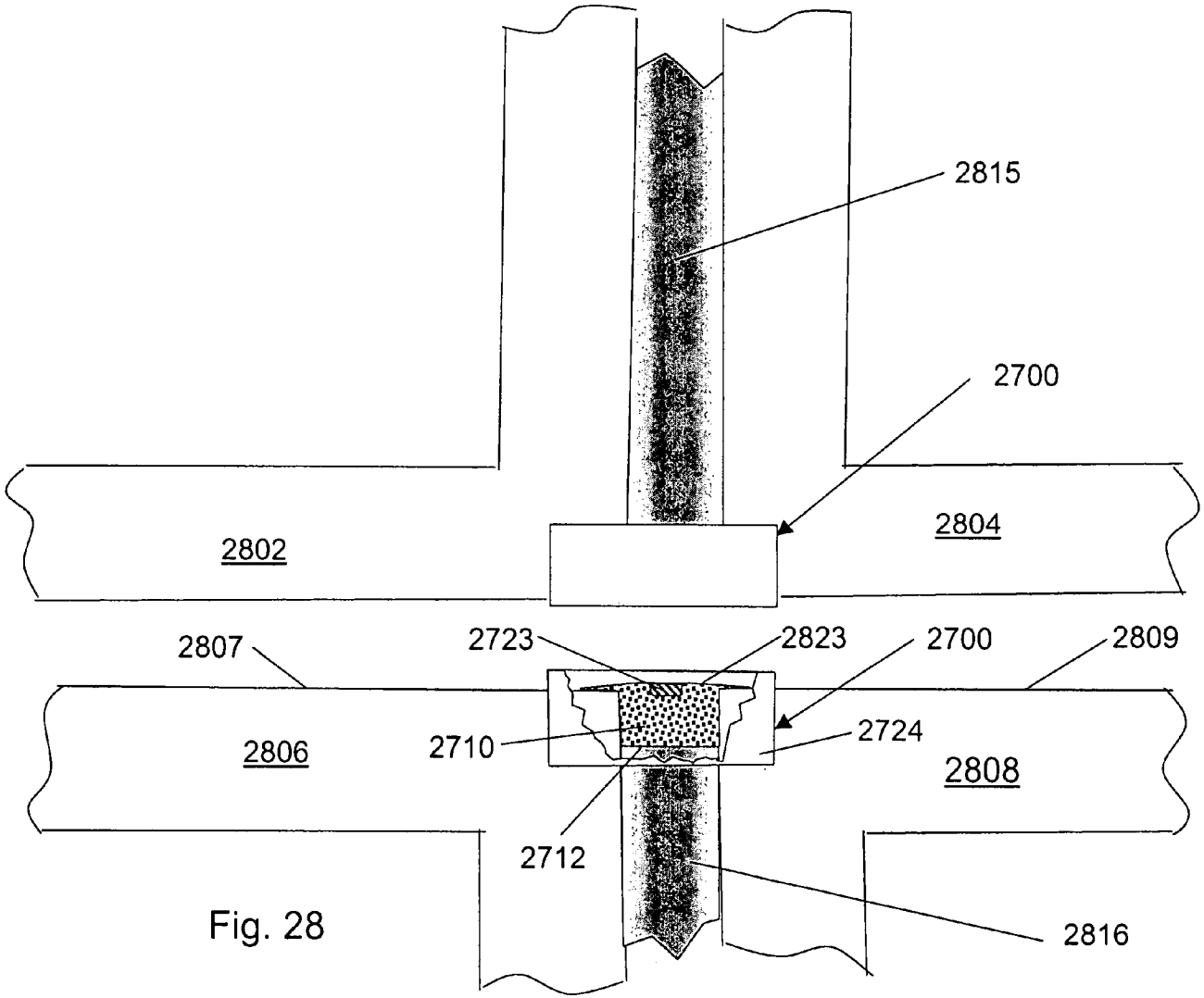
FIG. 28 is a cutaway view of the junction seal portrayed in FIGS. 27*a*-27*b*, installed in a compound fenestration unit.
Figure 29:
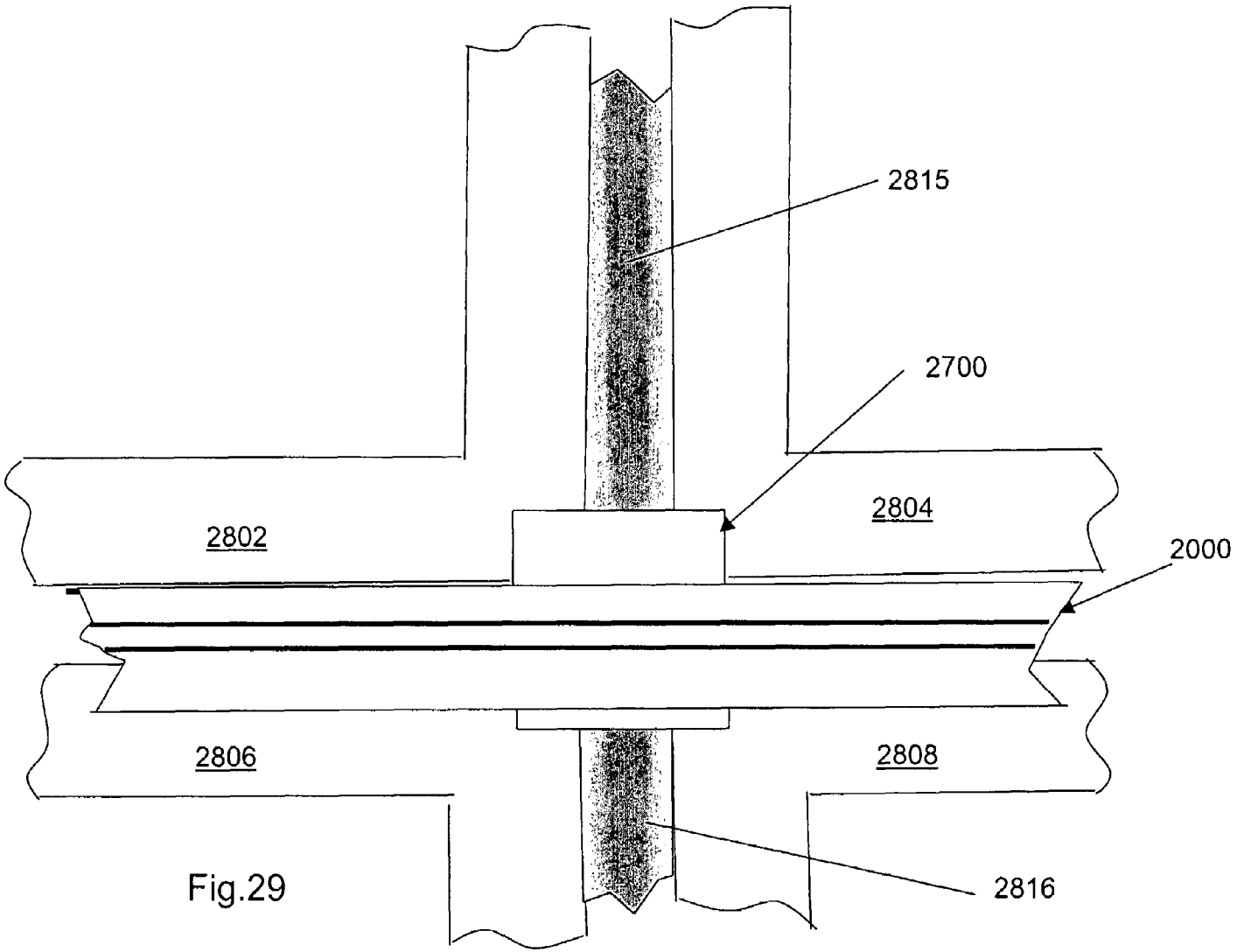
FIG. 29 is a partial view of a compound fenestration unit including junction seals and a horizontal sealing strip.

Referring to FIG. 28, the sealing of gaps at junctions is performed by first installing vertical sealing strips 2815 and 2816. Top and bottom junction seals 2700 are then installed, as shown, with surface 2712 of conformable material 2710 pressing against the ends of vertical seals 2815 and 2816, thereby completing the pressure seal. The thin edges of compliant sealing material 2710 form a low profile surface that merges with top surface 2807 of component unit 2806 and top surface 2809 of component unit 2808 to form a sufficiently smooth surface for bottom pressure seal 2020, shown in FIG. 20, of horizontal sealing strip 2000 to seal against it. Finally, referring to FIG. 29, horizontal sealing strip 2000 is installed. Because junction seal 2700 is adapted to provide a smooth, void free surface, without sharp transitions, against which interior seals 2010 and 2020 of horizontal sealing strip 2000 can seal, the presence of junction seals 2700 does not significantly disrupt the sealing of strip 2000 against the component window units. Conformable material 2710 is compressed against vertical sealing strips 1700 by pressure seals 2010 and 2020 of horizontal sealing strip 2000.

Figure 30:
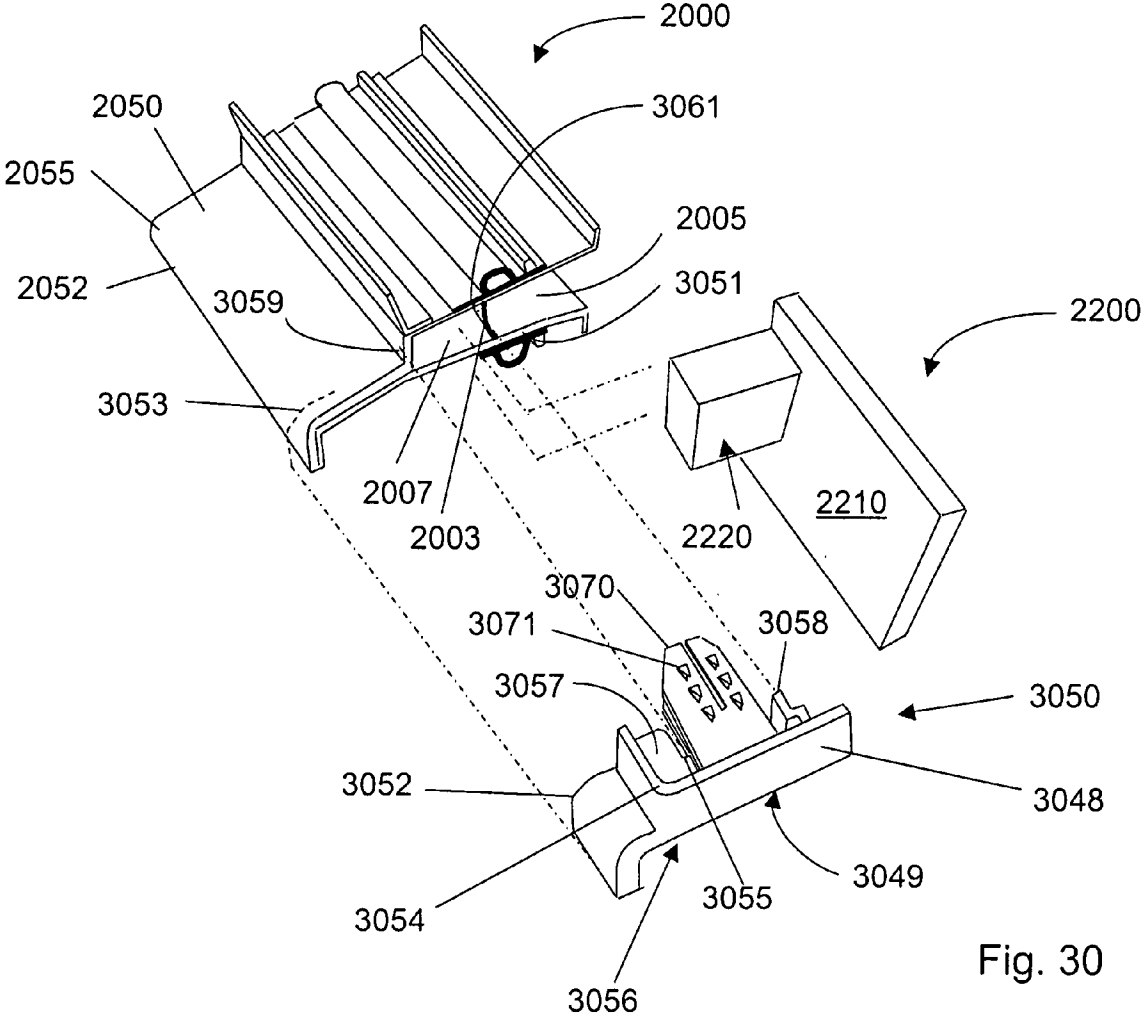
FIG. 30 is an exploded view of an embodiment of an end sealing system for a horizontal sealing strip.

The ends of horizontal sealing strip 2000 can be sealed by a sealing system of the type shown in FIG. 30. Right hand end cap 3050 comprises cover portion 3049 and retainer clip portion 3070. Cover portion 3049 further comprises notched rib 3057, wherein notch 3055 fits over the end of wall 3059 and seats against it. Barbed leaf retainer clip 3070 comprises an upper leaf, visible, and a lower leaf, not visible, which fit into cavity 2007, with barbs 3071 of the upper leaf and lower leaf engaging the upper and lower walls of cavity 2007, respectively. End cap 3050 is further located relative to end 3051 of strip 2000 by stop rib 3058, which rests against end 3051. Surface profile 3054 is shaped to match the exterior profile of the window frame against which it fits, so as to provide a harmonious appearance. In like manner, surface profile 3052 is similar to combined portions 2050 and 2052 of strip 2000, which it slightly overlaps, as shown by dashed lines 3053 in FIG. 30.

Figure 31:
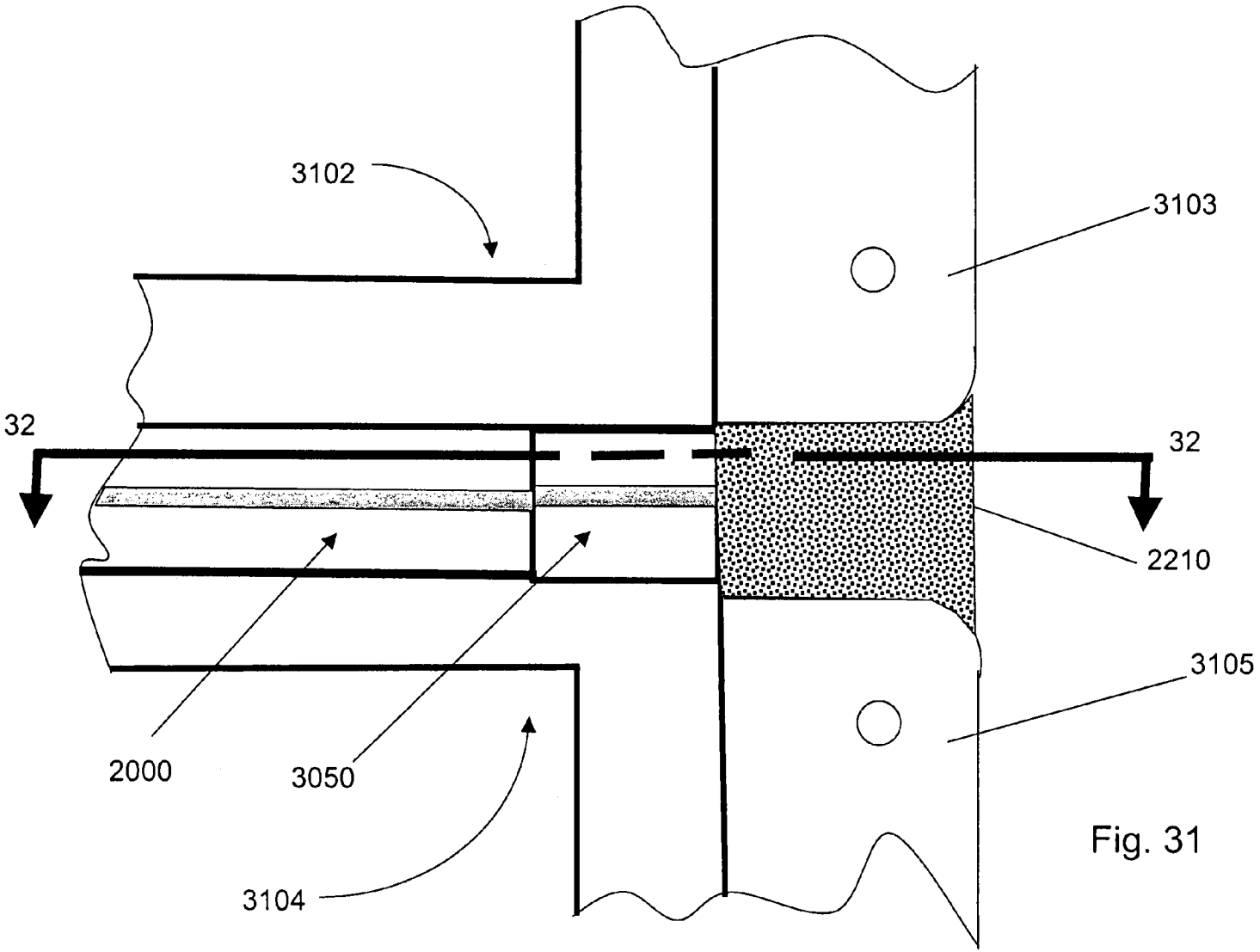
FIG. 31 is a partial front view of the end sealing system portrayed in FIG. 30, after installation of the seals.
Figure 32:
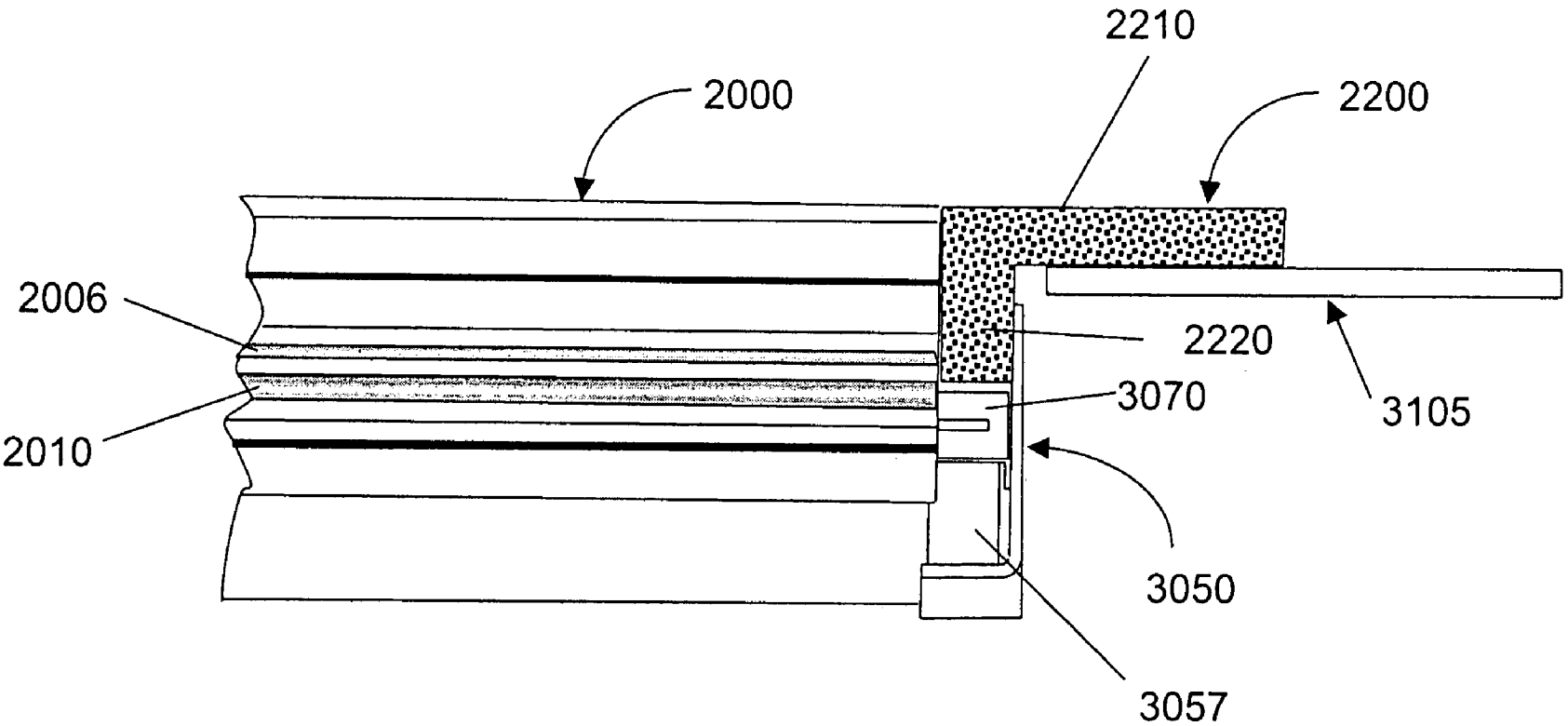
FIG. 32 is a cross sectional view of the end sealing system portrayed in FIG. 31.

End seal portion 2220 of flange seal 2200 is interposed between end cap 3050 and end 3051 of strip 2000 so as to provide a pressure seal of cavity 2005. Barbed retainer clip 3070 is useful in holding end cap 3050 tightly against seal 2220 so as to maintain a level of compression that is adequate for a pressure seal. As shown in FIGS. 31 and 32, portion 2210 of flange seal 2200 fits behind nailing flanges 3103 and 3105 of component units 3102 and 3104, with portion 2220 protruding through the gap between the window units and compressed against sealing strip 2000 by end cap 3050. Since exterior cavity 2007 is exterior to the pressure seal, it is not necessary for it to be sealed to end cap 3050, and it is useful for it not to be sealed, so as to provide ventilation to cavity 2007.

Figure 33:
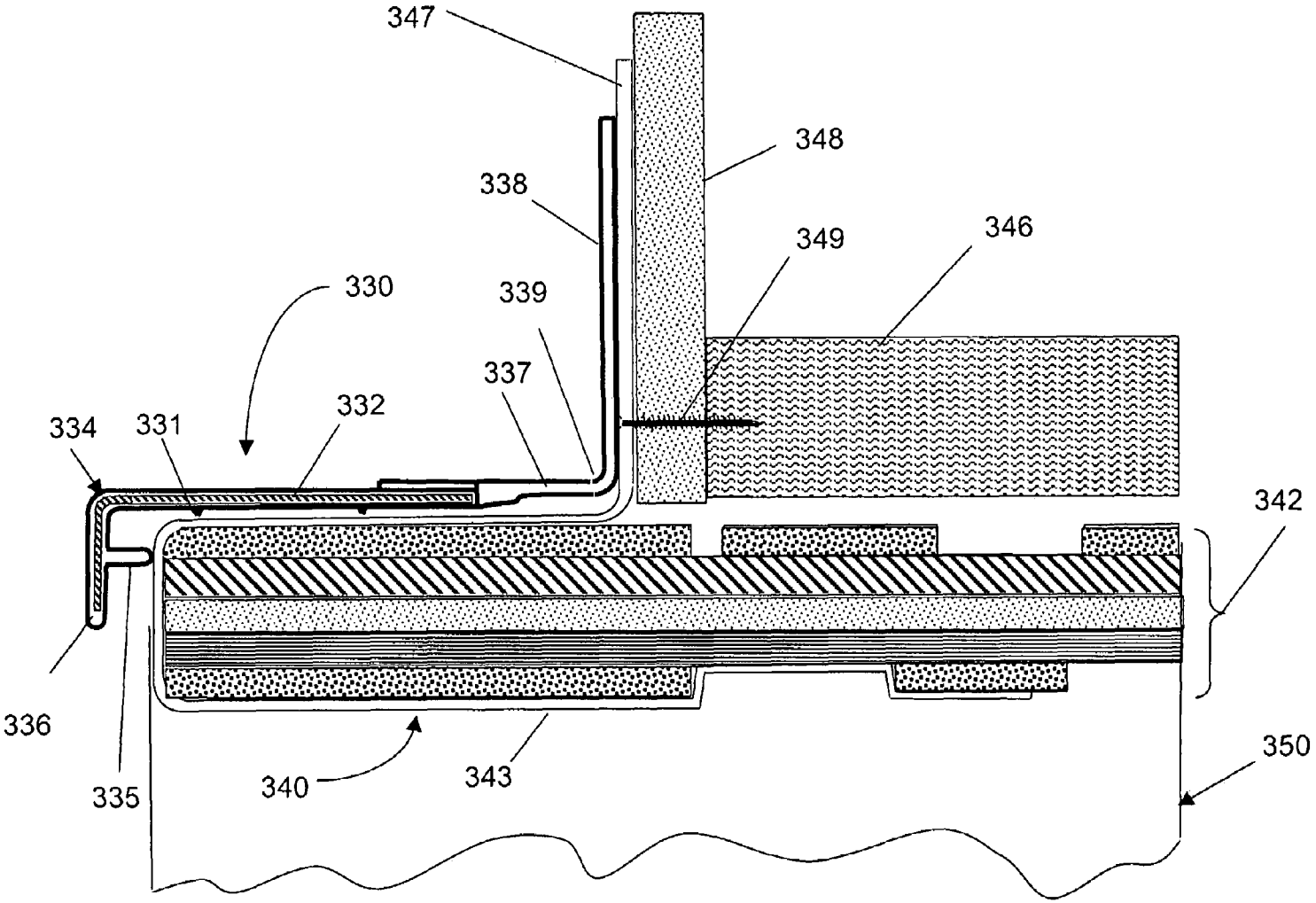
FIG. 33 is a cross sectional view of the top portion of a fenestration unit, including an embodiment of a drip edge.

Fenestration units of the present invention can be further protected against intrusion of water by the addition of a top drip cap. Referring to FIGS. 33, top rail portion 340 of a fenestration unit is shown installed in a rough opening having header 346, to which is attached sheathing 348. In this embodiment, top rail portion 340 comprises laminated wood core 342 and cladding 343. Nailing flange 347 is an integral extension of cladding 343. Cladding 343 is typically PVC, with an outer cap stock to impart weatherability and improved color, but may also be aluminum or other suitably durable and weatherable material.

Figure 34:
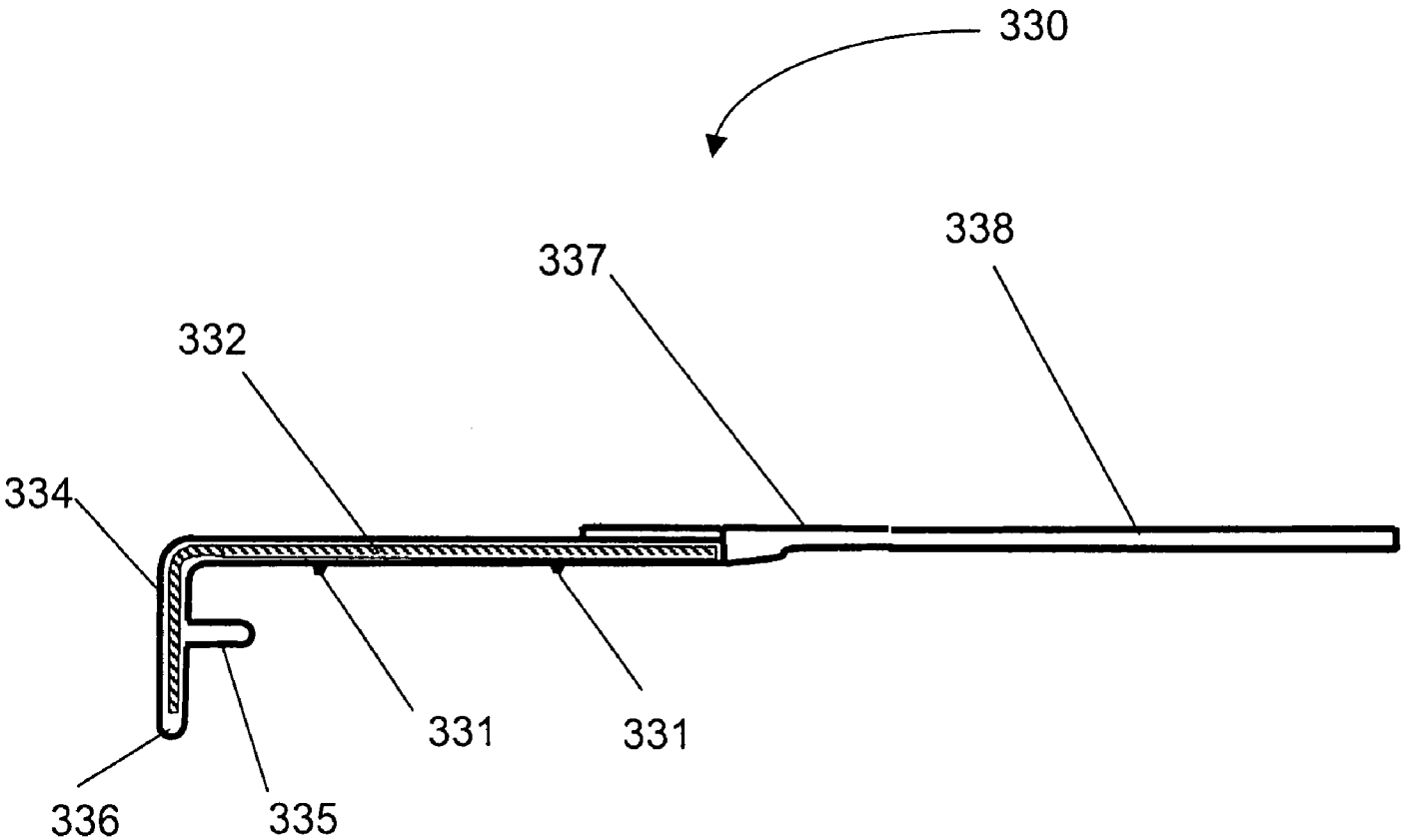
FIG. 34 is a cross sectional view of the drip edge portrayed in FIG. 33 prior to installation.

In a preferred embodiment, drip cap 330 comprises a mechanically and thermally stable core 332, over which is applied one or more polymeric layers to form nose portion 334, which is held in a spaced apart position from top rail 340 by spacer rib 335, so as to move dripping water away from the fenestration unit. Core 332 is preferably a relatively rigid material having a low coefficient of thermal expansion, having a low long term shrinkage. A material that has been found suitable is aluminum, although other materials such as pultruded fiberglass reinforced polymeric materials may also be useful in some applications. An aluminum core may have an advantage in some instances in that it is relatively easy to produce from sheet stock. A preferred polymeric material for the coating layers is PVC, which may be covered with a capstock material such as pigmented PVC or acrylic polymer. Acrylic polymers may be preferable in some instances, depending on color requirements and weathering conditions, for example. Drip cap 330 further comprises flexible sealing flap portion 338 which folds upward and fits against nailing flange 347. Referring to FIG. 34, drip cap 330 is formed by extrusion of polymeric material over aluminum core 332, with sealing flap extending in a substantially parallel direction with core 332. Since flap portion 338 is flexible, it can be bent at any suitable point to conform to a variety of fenestration unit dimensions.

Referring again to FIG. 34, drip cap 330 can be produced as a stock material by extruding polymeric material over core 332. It is preferred that the extruded polymeric material completely enclose core 332, and that it impart a suitable color to the visible portion of the drip cap. The polymeric material also forms nose portion 334, sealing flap 338, and sonic welding energy directors 331. When cladding 343 is a sonic weldable material such as PVC, drip cap 330 can be sonically welded to the cladding of the component units. When cladding 343 is not sonically weldable, a dual sided pressure sensitive tape foam tape, or other suitable adhesive means, can be used to attach drip cap 330 to cladding 343. Because sealing flap 338 is flexible, it can be pulled away from nailing flange 347 during installation to allow fasteners 349 to be installed through nailing flange 347 into sheathing 348 and header 346, so as to avoid puncturing it, thereby further reducing the risk of leakage.

We claim:

1. A compound fenestration assembly comprising:

a first fenestration unit having a frame formed of frame members each having an inwardly facing surface, an outwardly facing surface, an inside edge, and an outside edge;

a second fenestration unit having a frame formed of frame members each having an inwardly facing surface, an outwardly facing surface, an inside edge, and an outside edge;

a frame member of said first fenestration unit being joined to a frame member of said second fenestration unit such that a gap is formed between the outwardly facing surfaces of said joined frame members, said outwardly facing surfaces forming walls of said gap;

opposing kerfs formed in said walls of said gap between the inside and outside edges of said joined frame members;

a sealing strip disposed in and sealing said gap;

said sealing strip comprising a backbone disposed within said gap, a exterior seal on said backbone configured and positioned to seal said gap along the outside edges of said joined frame members, and an interior seal on said backbone spaced from said exterior seal and configured and positioned to seal said gap inboard of said outside edges of said joined frame members;

said sealing strip further comprising a pair of hooks shaped and positioned to engage with said opposing kerfs to locate and secure said sealing strip within said gap.

2. A compound fenestration assembly as claimed in claim 1 and wherein said backbone is resiliently outwardly biased to lodge said hooks within said kerfs to secure said backbone within said gap and seat said interior seal within said gap.

3. A compound fenestration assembly as claimed in claim 2 and wherein said backbone has a first leg and a second leg connected by a bight portion of said backbone, said first and second legs being resiliently biased away from each other.

4. A compound fenestration assembly as claimed in claim 3 and wherein said interior seal comprises a first seal member located on said first leg of said backbone and a second seal member located on said second leg of said backbone, said legs urging said first and second seal members outwardly into sealing engagement with the walls of said gap.

5. A compound fenestration assembly as claimed in claim 4 and wherein said exterior seal is located on said bight portion of said backbone.

6. A compound fenestration assembly as claimed in claim 5 and wherein a channel is formed between said exterior seal and said first and second seal members on each side of said gap, said channel confining and directing water that breaches said exterior seal downwardly toward a bottom of said fenestration assembly for being drained away from said assembly.

7. A compound fenestration assembly comprising first and second fenestration units having sides and being joined together side-to-side such that a gap is defined between the fenestration units, the gap having an outside edge and an inside edge, a pair of opposing kerfs formed in the sides of said fenestration units within said gap with said kerfs being located between said outside edge and said inside edge of said gap, and a sealing strip disposed in and sealing said gap at least along the outside edge thereof, said sealing strip having first and second legs that are resiliently biased apart with said legs bearing first seals for sealing said gap along said outside edge thereof and second seals for sealing said gap inboard of said outside edge thereof, and hooks projecting from said first and second legs inboard of said second seals, said hooks being lodged within said kerfs to position and secure said sealing strip within said gap.

8. A compound fenestration unit as claimed in claim 7 and further comprising a cross member extending between said legs of said sealing strip.

* * * * *

UNITED STATES PATENT AND TRADEMARK OFFICE

CERTIFICATE OF CORRECTION

PATENT NO. : 7,481,028 B2
APPLICATION NO. : 11/488479
DATED : January 27, 2009
INVENTOR(S) : Tufts et al.

It is certified that error appears in the above-identified patent and that said Letters Patent is hereby corrected as shown below:

Title Page;

Item (73) on the front page of the patent should be replaced with the following text:

(73) Assignee: Andersen Corporation, Bayport, MN (US)

Signed and Sealed this

Seventh Day of April, 2009

JOHN DOLL
*Acting Director of the United States Patent and Trademark Office*